US011500305B2

(12) United States Patent
Komatsu et al.

(10) Patent No.: US 11,500,305 B2
(45) Date of Patent: Nov. 15, 2022

(54) PROCESS CARTRIDGE HAVING TONER RECEIVING PORTION

(71) Applicant: CANON KABUSHIKI KAISHA, Tokyo (JP)

(72) Inventors: Noriyuki Komatsu, Shizuoka (JP); Tomonori Mori, Kanagawa (JP); Teruhiko Sasaki, Shizuoka (JP); Makoto Hayashida, Shizuoka (JP); Masakazu Tatsumi, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/530,745

(22) Filed: Nov. 19, 2021

(65) Prior Publication Data

US 2022/0075288 A1 Mar. 10, 2022

Related U.S. Application Data

(63) Continuation of application No. 17/128,954, filed on Dec. 21, 2020, now Pat. No. 11,209,749.

(30) Foreign Application Priority Data

Dec. 26, 2019 (JP) ..... JP2019-235902

(51) Int. Cl.
*G03G 15/08* (2006.01)
*G03G 21/18* (2006.01)

(52) U.S. Cl.
CPC ..... *G03G 15/0881* (2013.01); *G03G 15/0898* (2013.01); *G03G 21/1814* (2013.01); *G03G 15/0817* (2013.01)

(58) Field of Classification Search
CPC ..... G03G 15/0808; G03G 15/0817; G03G 15/0881; G03G 15/0898; G03G 21/1814
See application file for complete search history.

(56) References Cited

U.S. PATENT DOCUMENTS 7,239,824 B2 7/2007 Fukuta
9,823,621 B2 11/2017 Miyamoto
(Continued)

FOREIGN PATENT DOCUMENTS

JP H0980906 A 3/1997
JP H11338253 A 12/1999
(Continued)

OTHER PUBLICATIONS

Office Action issued in U.S. Appl. No. 17/128,954 dated Mar. 29, 2021.
(Continued)

*Primary Examiner* — Hoang X Ngo
(74) *Attorney, Agent, or Firm* — Rossi, Kimms & McDowell LLP

(57) ABSTRACT

A process cartridge includes a photosensitive member and a developing unit. The developing unit includes a frame to store toner, a developing roller to carry the toner, a side seal to contact an end portion of the developing roller and prevent the toner from leaking out, and a sealing sheet to contact a center portion of the developing roller and prevent the toner from leaking out. A toner receiving portion of the frame includes an opening facing the developing roller and is disposed on an upstream side of the side seal and a downstream side of a contact portion where the developing roller contacts the photosensitive member, and moreover is disposed at a position overlapping with the side seal. The developing unit includes a blocking member to block at least a part of the opening, and the blocking member is disposed between the opening and the developing roller.

12 Claims, 23 Drawing Sheets

(56) References Cited

U.S. PATENT DOCUMENTS

| | | | | |
|---|---|---|---|---|
| 9,835,978 | B2 * | 12/2017 | Castle | G03G 15/0817 |
| 10,365,586 | B1 * | 7/2019 | Goin | G03G 15/0817 |

FOREIGN PATENT DOCUMENTS

| | | | |
|---|---|---|---|
| JP | 2006098770 | A | 4/2006 |
| JP | 2016224221 | A | 12/2016 |

OTHER PUBLICATIONS

Notice of Allowance issued in U.S. Appl. No. 17/128,954 dated Aug. 26, 2021.

* cited by examiner

PROCESS CARTRIDGE HAVING TONER RECEIVING PORTION

BACKGROUND OF THE INVENTION

Field of the Invention

The present invention relates to a process cartridge.

Description of the Related Art

In an electrophotographic image forming apparatus, such as a laser beam printer and a copier, an image is formed on a recording material, i.e., a sheet, by forming a toner image on a photosensitive drum and transferring this toner image onto the sheet.

In a laser beam printer, in order to make maintenance easier, a system is widely used in which a part of components of an image forming apparatus is disposed in a process cartridge and the process cartridge is detached from an apparatus main body to perform maintenance or to replace the cartridge. Japanese Patent Application Publication No. 2016-224221 discloses a process cartridge, of which developing unit stores toner, is attachable to and detachable from a photosensitive unit including a photosensitive drum.

In a conventional process cartridge, in some cases toner in the process cartridge may scatter out of the process cartridge. An object of the present invention is to provide a process cartridge that can suppress scattering of toner out of the process cartridge.

SUMMARY OF THE INVENTION

In order to achieve the object described above, a process cartridge including:

a photosensitive unit including a photosensitive member; and a developing unit configured to be attachable to and detachable from the photosensitive unit, the developing unit including a frame configured to store toner, a developing roller configured to carry the toner and be rotatable to convey the toner to the photosensitive member, a side seal configured to contact an end portion of the developing roller in a rotation axis direction of the developing roller and prevent the toner from leaking to outside through a gap between the developing roller and the frame, and a sealing sheet configured to contact a center portion of the developing roller in the rotation axis direction and prevent the toner from leaking to outside through a gap between the developing roller and the frame, wherein the frame includes a toner receiving portion, the toner receiving portion includes an opening facing the developing roller and is disposed on an upstream side of the side seal and a downstream side of a contact portion where the developing roller contacts the photosensitive member in a rotating direction of the developing roller, and moreover is disposed at a position overlapping with the side seal in the rotation axis direction of the developing roller, and the developing unit includes a blocking member configured to block at least a part of the opening, and the blocking member is disposed between the opening and the developing roller.

In order to achieve the object described above, a process cartridge including:

a photosensitive unit including a photosensitive member; and a developing unit configured to be attachable to and detachable from the photosensitive unit, the developing unit including a frame configured to store toner, a developing roller configured to carry the toner and be rotatable to convey the toner to the photosensitive member, a side seal configured to contact an end portion of the developing roller in a rotation axis direction of the developing roller and prevent the toner from leaking to outside through a gap between the developing roller and the frame, and a sealing sheet configured to contact a center portion of the developing roller in the rotation axis direction and prevent the toner from leaking to outside through a gap between the developing roller and the frame, wherein the frame includes a toner receiving portion, the toner receiving portion includes an opening facing the developing roller and is disposed on an upstream side of the side seal and a downstream side of a contact portion where the developing roller contacts the photosensitive member in a rotating direction of the developing roller, and moreover is disposed at a position overlapping with the side seal in the rotation axis direction of the developing roller, the frame has a mounting surface on which the side seal is mounted, the toner receiving portion has a concave portion that is recessed downward from the mounting surface in a gravitational direction, and a bottom portion of the toner receiving portion is located lower than the mounting surface in the gravitational direction in a posture when the process cartridge is in use.

Further features of the present invention will become apparent from the following description of exemplary embodiments (with reference to the attached drawings).

DESCRIPTION OF THE EMBODIMENTS

Figure 1:
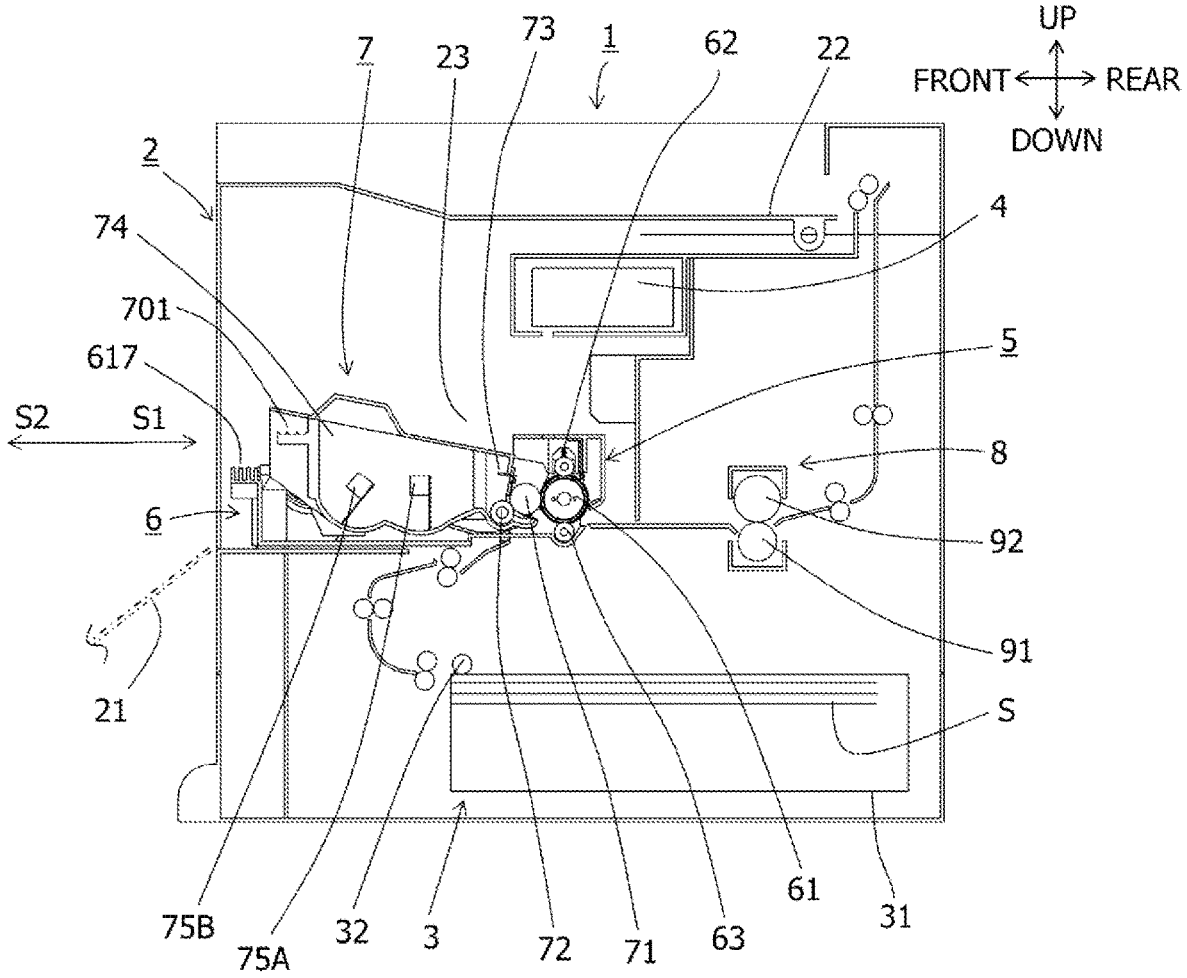
FIG. 1 is a cross-sectional view of an image forming apparatus equipped with a process cartridge.

Embodiments of the present invention will now be described with reference to the drawings. Dimensions, materials, shapes of the components and the relative positions thereof described in the embodiments may be appropriately changed depending on the configuration of an apparatus to which the present invention is applied, and on various conditions, and are not intended to limit the scope of the invention to the following embodiments.

Embodiment 1

Embodiment 1 of the present invention will be described in detail with reference to the drawings.

In the following description, directions with respect to the user who uses an image forming apparatus 1 are defined. A front face side of the image forming apparatus 1 is defined as "front", a rear face side as "rear", an upper face (top face) side as "up", and a lower face (bottom face) side as "down". Further, a left side of the image forming apparatus 1, when the image forming apparatus 1 is viewed from the front face side, is defined as "left", and the right side thereof as "right". The same directions as the image forming apparatus 1 are defined for the process cartridge 5, under the assumption that the process cartridge 5 is in the same posture as that used when the process cartridge 5 is attached to the image forming apparatus 1. Each direction in each drawing is defined using arrow marks indicated in the drawings. A front-rear direction, an up-down direction and a left-right direction indicated by the arrow marks are perpendicular to one another. The definition of the directions is the same for all the drawings. The up-down direction is parallel with the vertical direction, and the left-right direction and the front-rear direction are parallel with the horizontal direction. The left-right direction is also parallel with a rotation axis direction of a photosensitive drum 61 and a rotation axis direction of a developing roller 71 respectively. A process cartridge 5 is a unit where a developing unit 7 is attached to and integrated with a photosensitive unit 6. The process cartridge 5 is attached in the arrow S1 direction (attaching direction) in FIG. 1 when the process cartridge 5 is attached to an apparatus main body 2, and is detached in the arrow S2 direction in FIG. 1.

General Configuration of Image Forming Apparatus

FIG. 1 is a cross-sectional view of the image forming apparatus 1 when the process cartridge 5 is attached. As illustrated in FIG. 1, the image forming apparatus 1 includes: a paper feeding portion 3 to feed paper S into the apparatus main body 2; an exposing apparatus 4; the process cartridge 5 that transfers a toner image onto the paper S; and a fixing apparatus 8 that thermally fixes the transferred toner image on the paper S.

The paper feeding portion 3 is disposed in a lower area of the apparatus main body 2, and includes a paper feeding tray 31 and a paper feeding mechanism 32. The paper S stored in the paper feeding tray 31 is fed toward the process cartridge 5 (between the photosensitive drum 61 and the transfer roller 63) by the paper feeding mechanism 32.

The exposing apparatus 4 is disposed in an upper area in the apparatus main body 2, and includes a laser-emitting portion (not illustrated) and a polygon mirror, a lens, a reflecting mirror, and the like (not denoted by reference signs). In this exposing apparatus 4, using a laser beam emitted from the laser-emitting portion based on image data, the surface of the photosensitive drum 61, i.e., photosensitive member, is scanned at high-speed, whereby the surface of the photosensitive drum 61 is exposed.

The process cartridge 5 is disposed below the exposing apparatus 4. The process cartridge 5 is inserted from an opening that is formed in the apparatus main body 2 when a door (open/close member) 21 disposed in the apparatus main body 2 is opened (indicated by the two-dot chain line in FIG. 1), into a storing portion 23 of the apparatus main body 2 along an inserting direction S1, whereby the process cartridge 5 is attached to the apparatus main body 2. To detach the process cartridge 5 from the apparatus main body 2, the process cartridge 5 is moved along the detaching direction S2 and is detached.

The process cartridge 5 includes the photosensitive unit 6 and the developing unit 7. The photosensitive unit 6 includes the photosensitive drum 61, a charging roller 62 and the transfer roller 63. The developing unit 7 is configured to be attachable to and detachable from the photosensitive unit 6. The developing unit 7 includes the developing roller 71, a supplying roller 72, a layer thickness regulation blade 73, a toner storing portion (developer storing portion) 74 that stores toner (developer), and a first agitator 75A and a second agitator 75B which are disposed in the toner storing portion 74.

Image Forming Process

An image forming process using this process cartridge 5 will be described next. The photosensitive drum 61 is rotary-driven during execution of the image forming process. First the surface of the photosensitive drum 61 is uniformly charged by the charging roller 62, and is then exposed using a laser beam, which is emitted from the exposing apparatus 4 in accordance with the image data, whereby an electrostatic latent image corresponding to the image data is formed on the photosensitive drum 61.

Toner inside the toner storing portion 74 is stirred by the second agitator 75B and the first agitator 75A, and is then fed to the developing roller 71 via the supplying roller 72. The toner fed to the developing roller 71 enters between the developing roller 71 and the layer thickness regulation blade 73, and is carried on the developing roller 71 as a predetermined thickness of thin layer toner.

The toner carried on the developing roller 71 is fed to the electrostatic latent image formed on the photosensitive drum 61. Thereby toner attaches to the electrostatic latent image to make the image visible, and a toner image is formed on the photosensitive drum 61. Then the paper S is conveyed between the photosensitive drum 61 and the transfer roller 63, whereby the toner image on the photosensitive drum 61 is transferred onto the paper S. At this time, the untransferred toner remaining on the photosensitive drum 61 is collected by the developing roller 71, and is returned back to the developing unit 7.

A fixing apparatus 8 is disposed behind the process cartridge 5, and includes a heat roller 92 and a pressure roller 91. The paper S on which the toner image has been transferred passes through the fixing apparatus 8, and during this processing, the paper S is heated and pressed between the heat roller 92 and the pressure roller 91, whereby the toner image is fixed onto the paper S. The paper S that passed through the fixing apparatus 8 is discharged into a paper delivery tray 22.

Configuration of Process Cartridge

Each unit of the process cartridge 5 will be described next. As mentioned above, the process cartridge 5 includes the photosensitive unit 6 and the developing unit 7 which is attachable to and detachable from the photosensitive unit 6.

Configuration of Developing Unit

Figure 2:
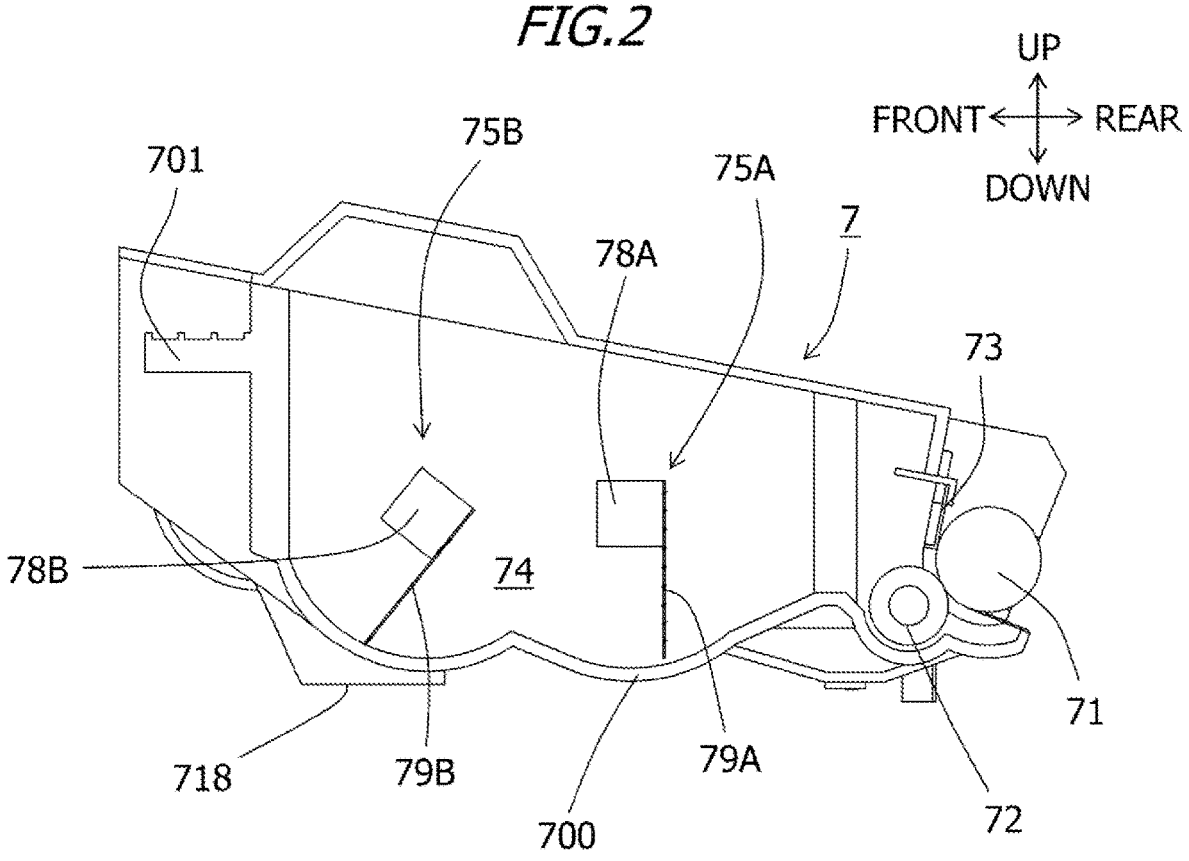
FIG. 2 is a cross-sectional view of a developing unit.
Figure 3:
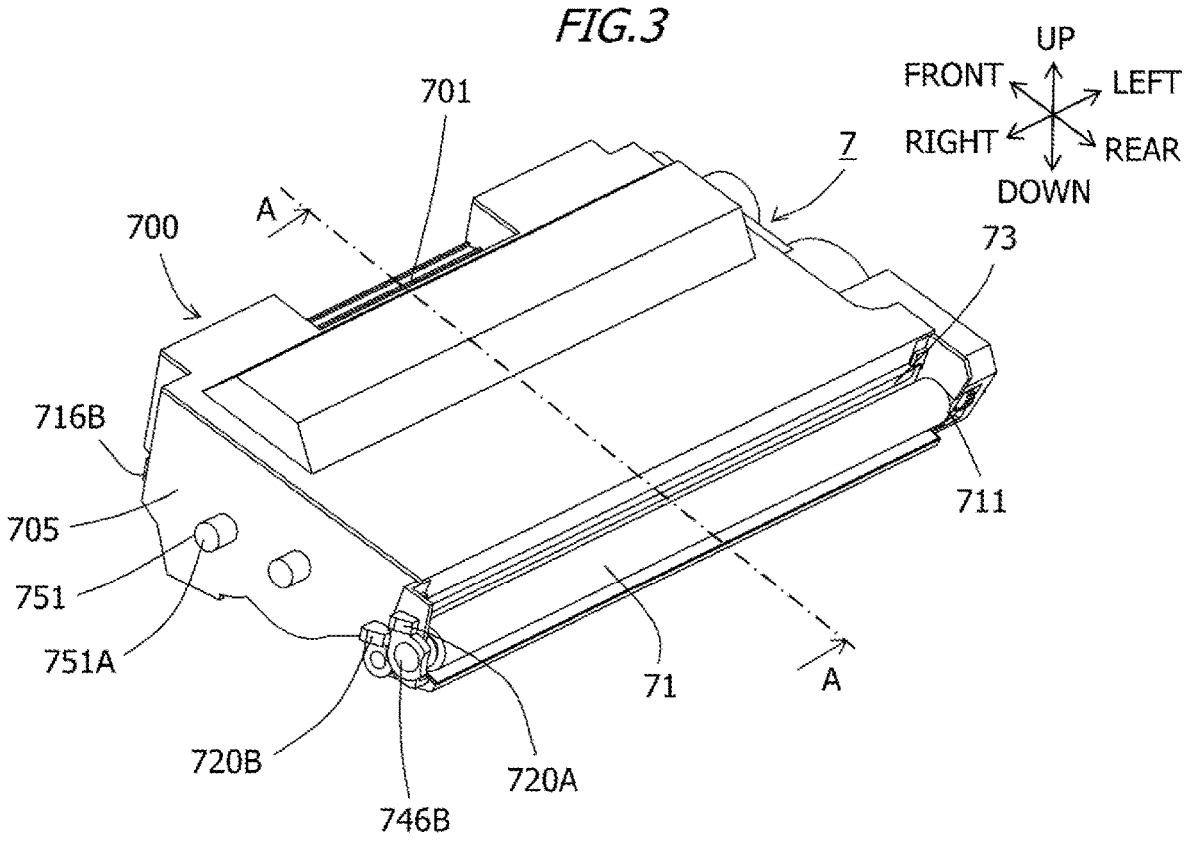
FIG. 3 is a perspective view of the developing unit.
Figure 4:
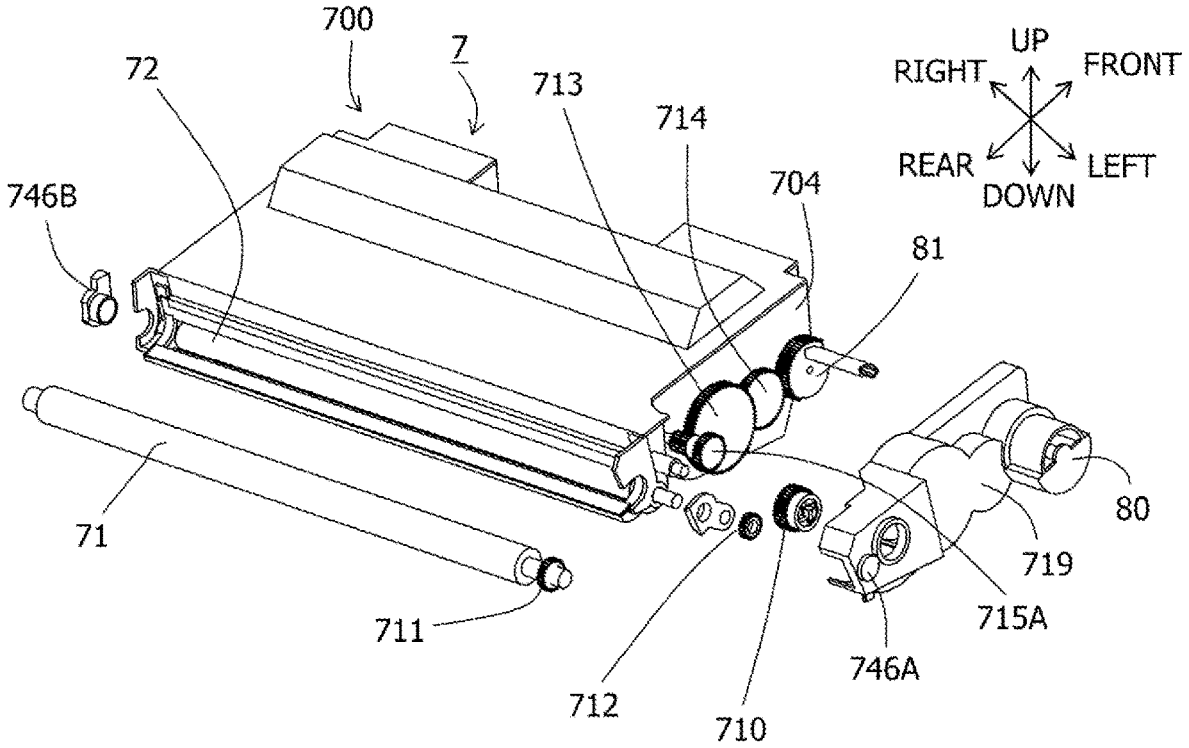
FIG. 4 is an exploded perspective view of the developing unit.
Figure 5:
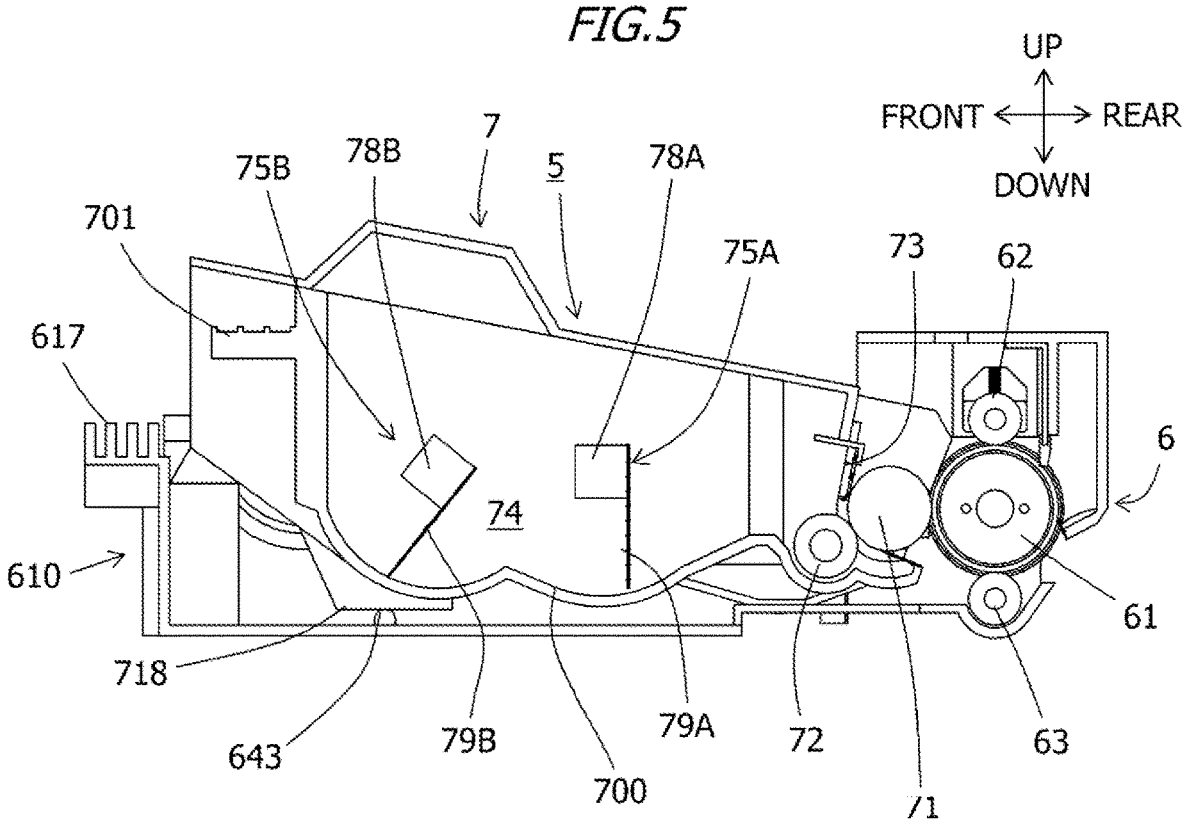
FIG. 5 is a cross-sectional view of the developing unit.
Figure 6:
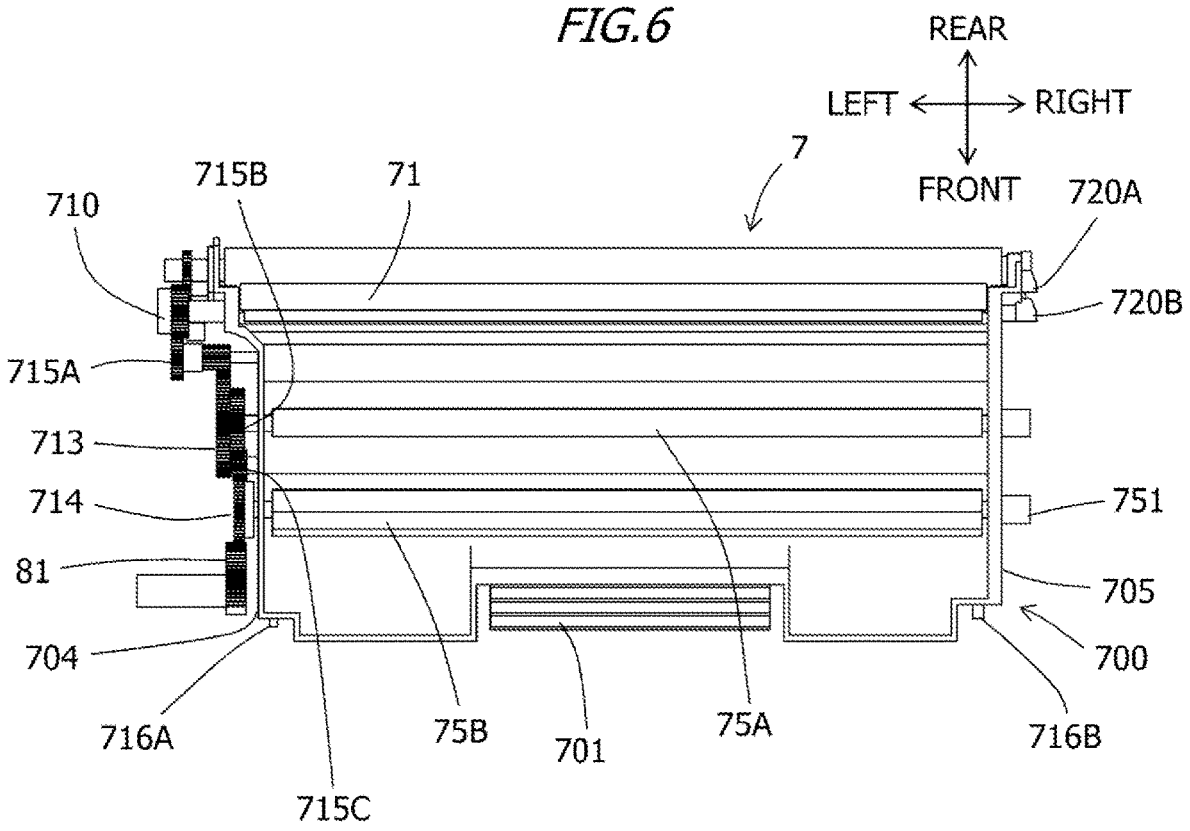
FIG. 6 is a top view of the developing unit.
Figure 7:
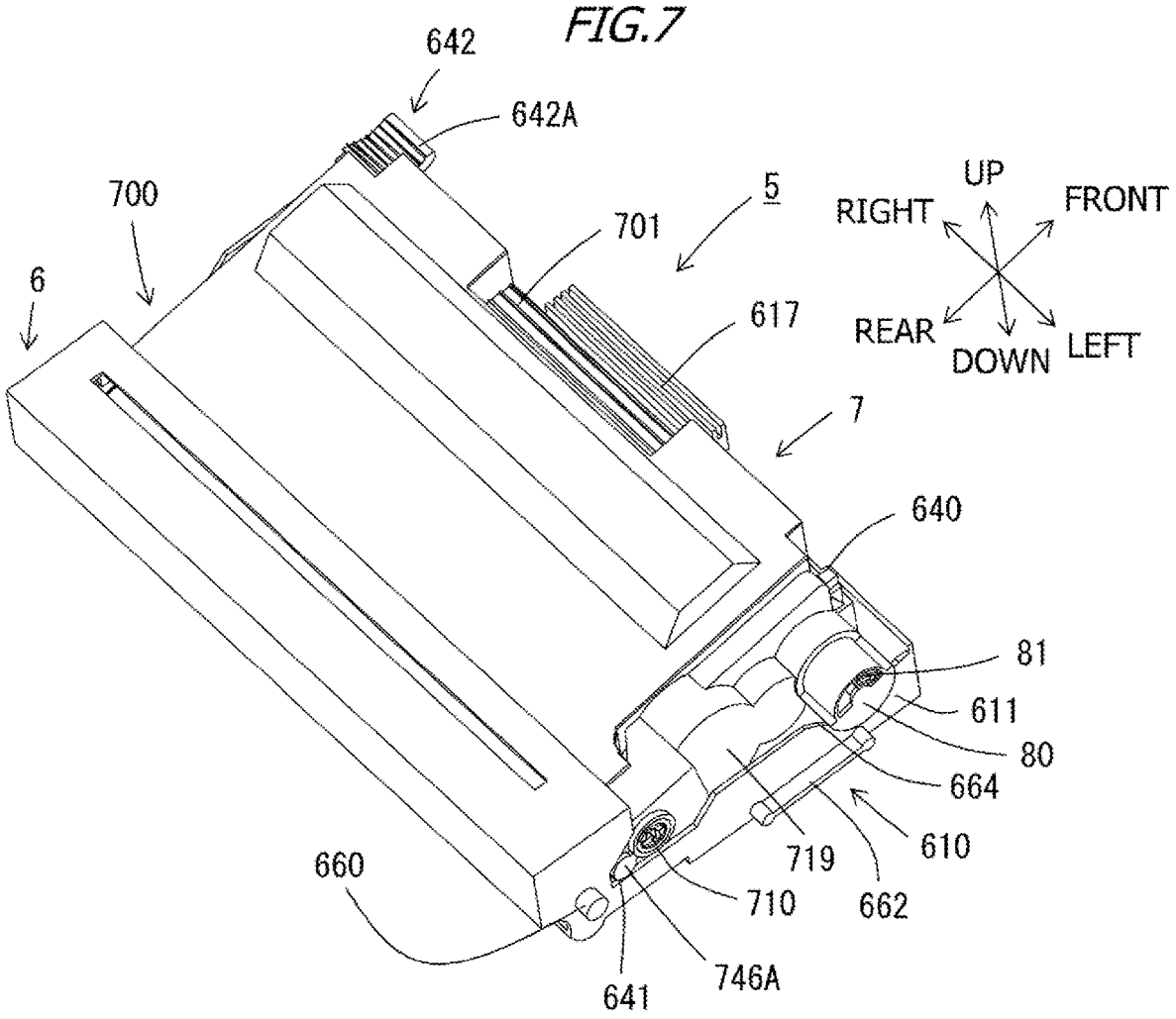
FIG. 7 is a perspective view of a process cartridge.

A configuration of the developing unit 7 will be described first. FIG. 2 is a cross-sectional view of the developing unit 7, and is a cross-sectional view sectioned at A-A in FIG. 3. FIG. 3 is a perspective view when the developing unit 7 is viewed from the top, and FIG. 7 is a perspective view when the process cartridge 5 is viewed from the top. FIG. 4 is an exploded perspective view of the developing unit 7. FIG. 5 is a cross-sectional view of the developing unit 7 attached to the photosensitive unit 6, and this cross-section is parallel with the up-down direction and the front-rear direction. FIG. 6 is a top view of the developing unit 7, and for explanatory convenience, a top face of a housing and the side holder 719 are omitted.

As illustrated in FIG. 2, the developing unit 7 includes a gripping portion 701, which is held by the user, in the front area of the housing (developing frame) 700, which is a frame body, and a developing roller 71 is rotatably supported in the rear area of the housing 700. A configuration of the developing unit 7 will be described below, defining the rotation axis direction of the developing roller 71 as the axis direction.

As illustrated in FIG. 4 and FIG. 6, both ends of the developing roller 71, the supplying roller 72, the first agitator (first stirring member) 75A and the second agitator (second stirring member) 75B are rotatably supported by a left side wall 704 and a right side wall 705 of the housing 700 respectively. On the left of the left side wall 704 of the housing 700, a developing coupling 710, a developing roller gear 711, a supplying roller gear 712, a first agitator gear 713, a second agitator gear 714, and idle gears 715A, 715B and 715C are disposed. The developing roller gear 711 is fixed to the end of the developing roller 71, and the supplying roller gear 712 is fixed to the end of the supplying roller 72. The first agitator gear 713 is fixed to the end of a stirring rod 78A (see FIG. 5) of the first agitator 75A, and the second agitator gear 714 is fixed to the end of a stirring rod 78B (see FIG. 5) of the second agitator 75B.

As illustrated in FIG. 3, the developing unit 7 includes a first electric contact 720A which is electrically connected with the developing roller 71 and to which voltage that is to be applied to the developing roller 71 is supplied. Further, as illustrated in FIG. 3, the developing unit 7 includes a second electric contact 720B which is electrically connected with the supplying roller 72 and to which voltage, to be applied to the supplying roller 72, is supplied. By these electric contacts contacting a power supply contact (not illustrated) disposed in the apparatus main body 2, the power is supplied to the developing roller 71 and the supplying roller 72.

Interlocking with the operation of closing the door 21 disposed in the apparatus main body 2, a developing drive transfer member (not illustrated), disposed in the apparatus main body 2, moves to a position to engage with the developing coupling 710. Further, interlocking with the operation of opening the door 21, the developing drive transfer member moves to a position to release the engagement with the developing coupling 710.

When the apparatus main body 2 operates after the door 21 is closed, the drive force is transferred (inputted) from the developing drive transfer member to the developing coupling 710, i.e., driving force receiving member. Then the developing roller 71 can be rotated by a gear formed on the peripheral surface of the developing coupling 710 via the developing roller gear 711, and the supplying roller 72 can be rotated by a gear formed on the peripheral surface of the developing coupling 710 via the supplying roller gear 712. The developing drive transfer member is configured to transfer the drive force to the developing coupling 710, allowing displacement of the developing coupling 710 within a predetermined range. The movement of the developing coupling 710, the developing roller gear 711 and the supplying roller gear 712 in the axis direction is regulated by a side holder 719, which is disposed in the housing 700.

The development unit 7 stirs the toner inside the toner storing portion 74 using two agitators: the first agitator 75A and the second agitator 75B. The first agitator 75A includes the stirring rod 78A and a stirring sheet 79A. The first agitator 75A is configured to be rotated by the first agitator gear 713 which receives the driving force from the developing coupling 710 via the idle gear 715A. The second agitator 75B includes the stirring rod 78B and a stirring sheet 79B. The second agitator 75B is configured to be rotated by the second agitator gear 714 which receives the driving force from the first agitator gear 713 via the idle gears 715B and 715C.

The second agitator 75B feeds the toner inside the toner storing portion 74 toward the first agitator 75A side. The toner near the first agitator 75A inside the toner storing portion 74 is stirred by the first agitator 75A and is fed toward the supplying roller 72 side, and is then fed to the developing roller 71 by the supplying roller 72.

As illustrated in FIG. 4 and FIG. 7, a detecting portion 80 is disposed on the left side end of the developing unit 7. The detecting portion 80 is included so that a detecting mechanism (not illustrated), which is disposed in the apparatus main body 2, can detect the state of a detecting member 81 disposed therein. Depending on the state of this detecting member 81, it can be determined whether the developing unit 7 is an unused unit or an already used unit.

Figure 8A:
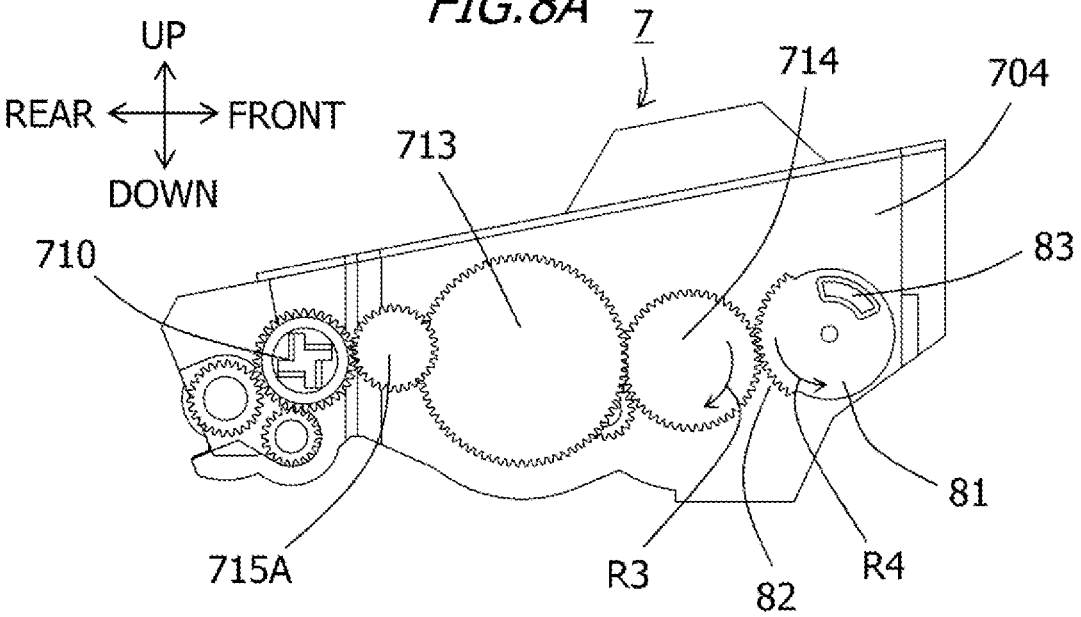
FIG. 8A and FIG. 8B are explanatory drawings of a detecting member.
Figure 8B:
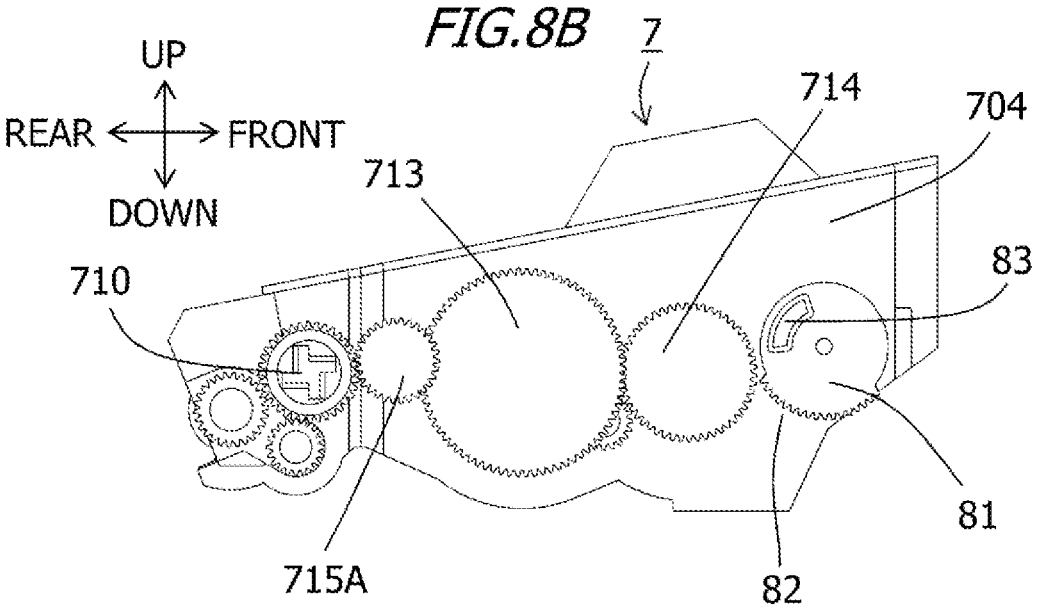

The operation state of the detecting member 81 will be described with reference to FIG. 8A and FIG. 8B. FIG. 8A and FIG. 8B are views of the developing unit 7 from the left side face. For explanatory convenience, in FIG. 8A and FIG. 8B, the side holder 719 is omitted. As illustrated in FIG. 8A and FIG. 8B, a detecting protrusion 83 and a detecting gear 82 are disposed in the detecting member 81. As illustrated in FIG. 8A and FIG. 8B, the detecting gear 82 is a partially-toothless gear. The detecting member 81 receives driving force from the second agitator gear 714 via the detecting gear 82.

FIG. 8A indicates a state where the developing unit 7 is unused. The detecting protrusion 83 is located on the upper front side of the detecting member 81. In the state where the developing unit 7 is unused, the detecting gear 82 is engaged with the second agitator gear 714. When the developing unit 7 is used, the second agitator gear 714 is rotated in the arrow R3 direction in FIG. 8A by the driving force, which the developing coupling 710 received from the developing drive transfer member of the apparatus main body 2. In this case, the detecting member 81 rotates in the arrow R4 direction in FIG. 8A, since the detecting gear 82 is engaged with the second agitator gear 714. FIG. 8B indicates a state after the detecting member 81 rotated. Since the detecting gear 82 is a partially-toothless gear, the detecting member 81 rotates in the arrow R4 direction in FIG. 8A, and the detecting member 81 stops rotation when there are no more gear teeth of the detecting gear 82 to engage with the second agitator gear 714. At this time, the detecting protrusion 83 is located on the upper rear side of the detecting member 81. By detecting the position of the detecting protrusion 83 of the detecting member 81 using a detecting mechanism (not illustrated) disposed in the apparatus main body 2, it can be determined whether the developing unit 7 is an unused unit or an already used unit.

Figure 9:
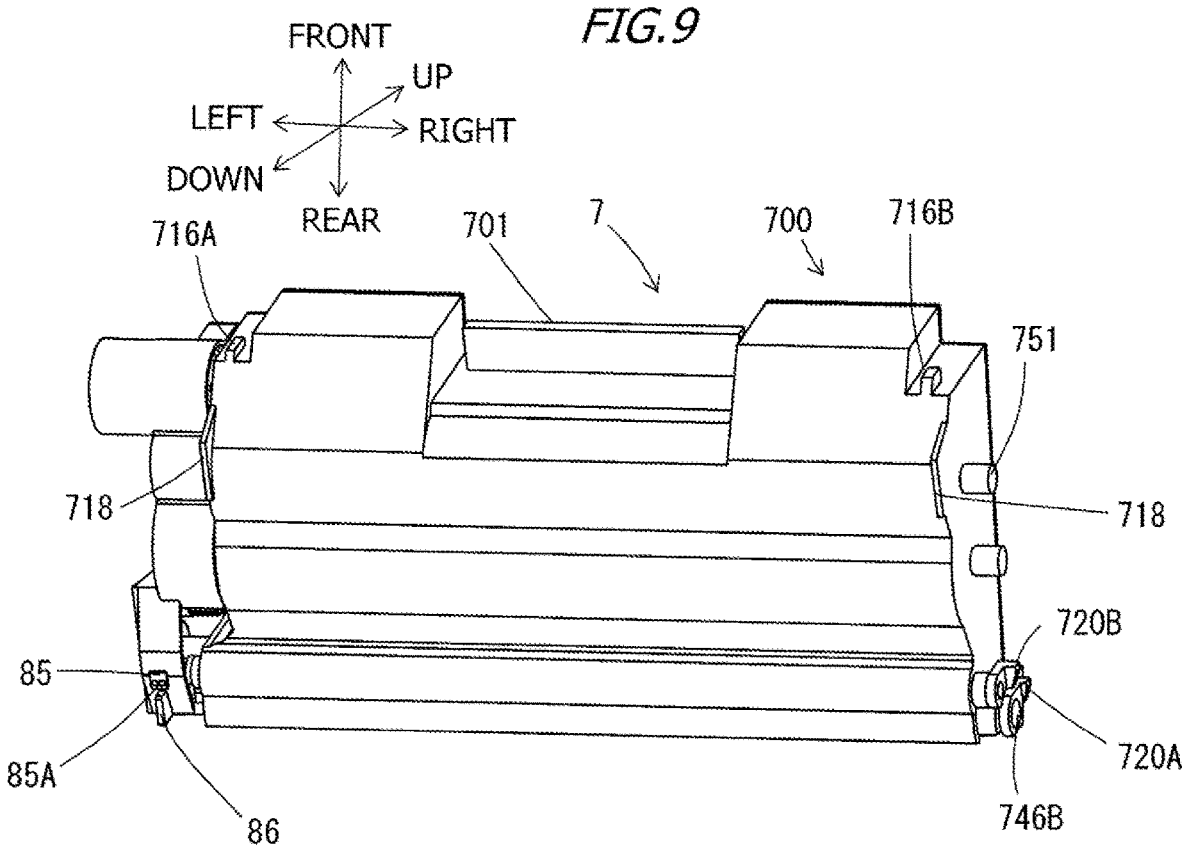
FIG. 9 is a perspective view of the developing unit.

FIG. 9 is a perspective view when the developing unit 7 is viewed from the bottom. As illustrated in FIG. 9, a memory 85 and a positioning protrusion 86 are disposed on the bottom surface of the developing unit 7. The memory 85 includes a memory chip (not illustrated) which stores information on the developing unit 7, and a memory electrode 85A which is conducted with the memory chip. The memory electrode 85A contacts an electrode (not illustrated) disposed in the apparatus main body 2 to perform communication between the memory chip and the apparatus main body 2.

Configuration of Photosensitive Unit and Support of Developing Unit

Figure 10:
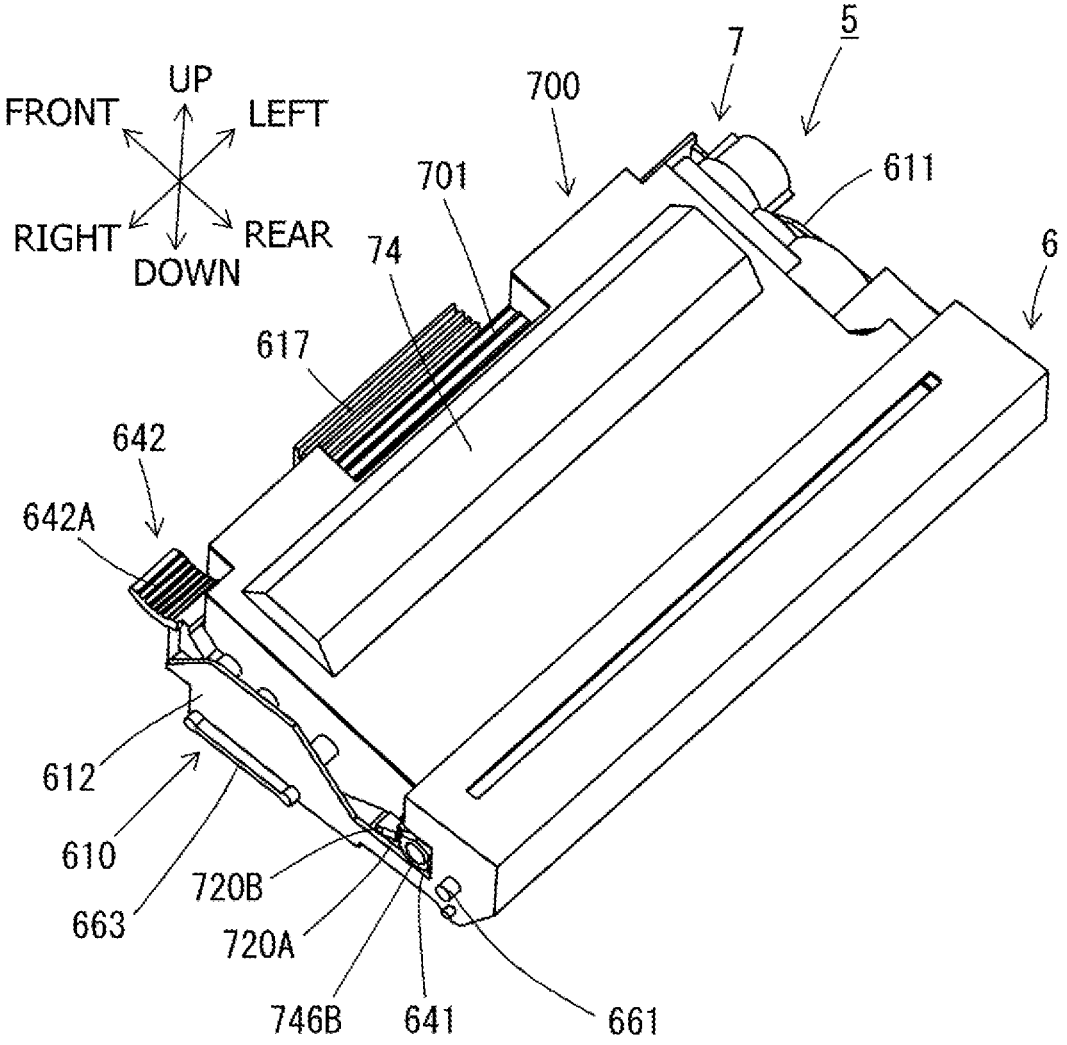
FIG. 10 is a perspective view of the process cartridge.
Figure 11A:
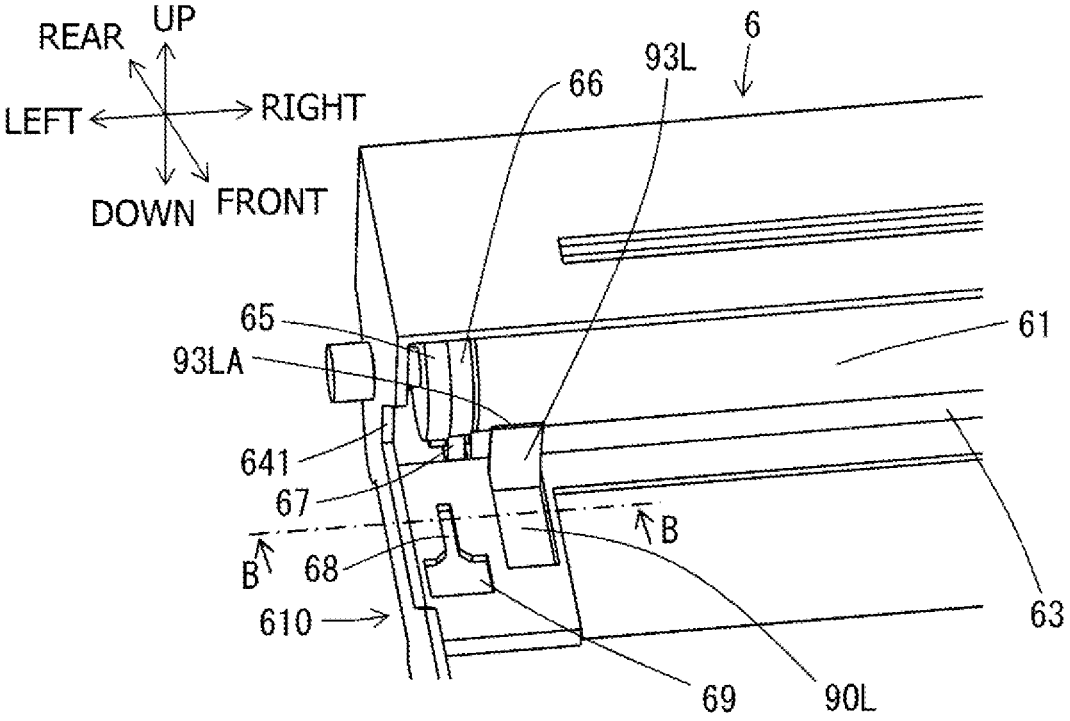
FIG. 11A and FIG. 11B are partial perspective views of a photosensitive unit.
Figure 11B:
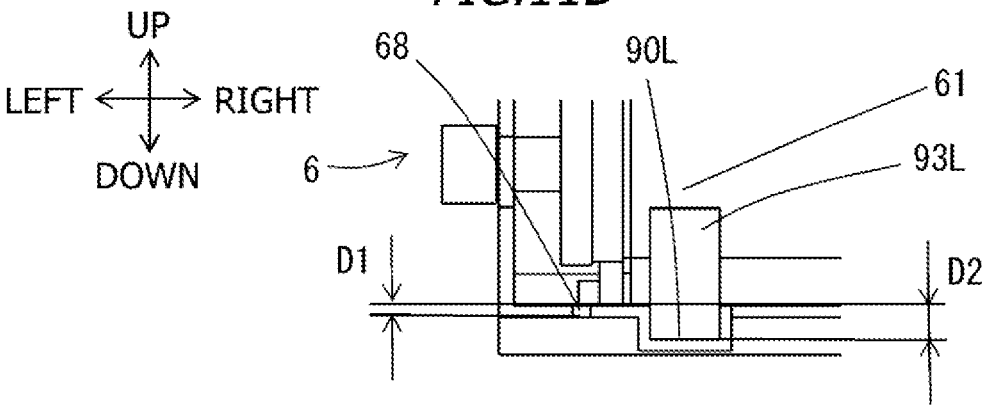
Figure 12:
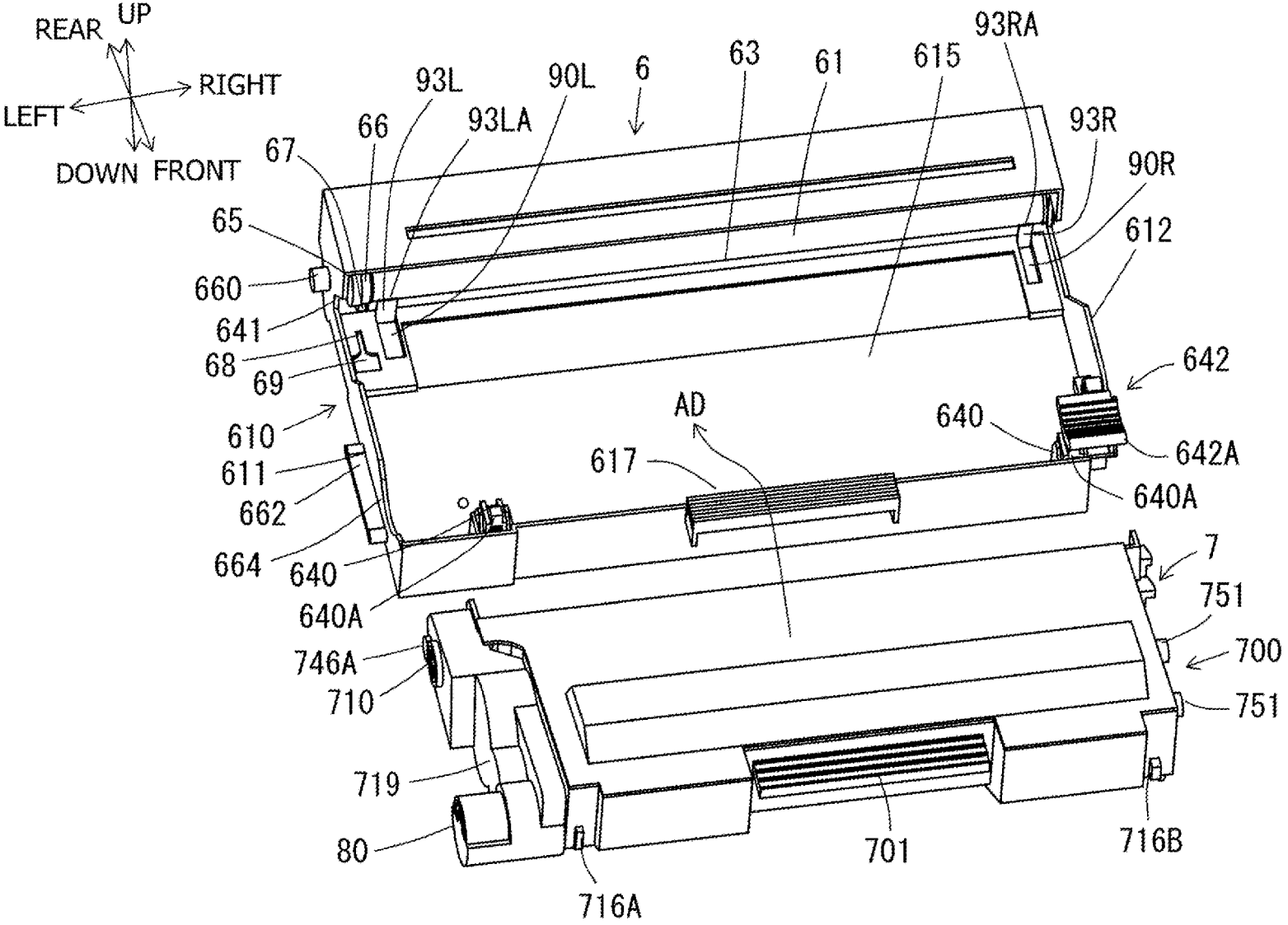
FIG. 12 is a perspective view of the developing unit and the photosensitive unit.
Figure 13:
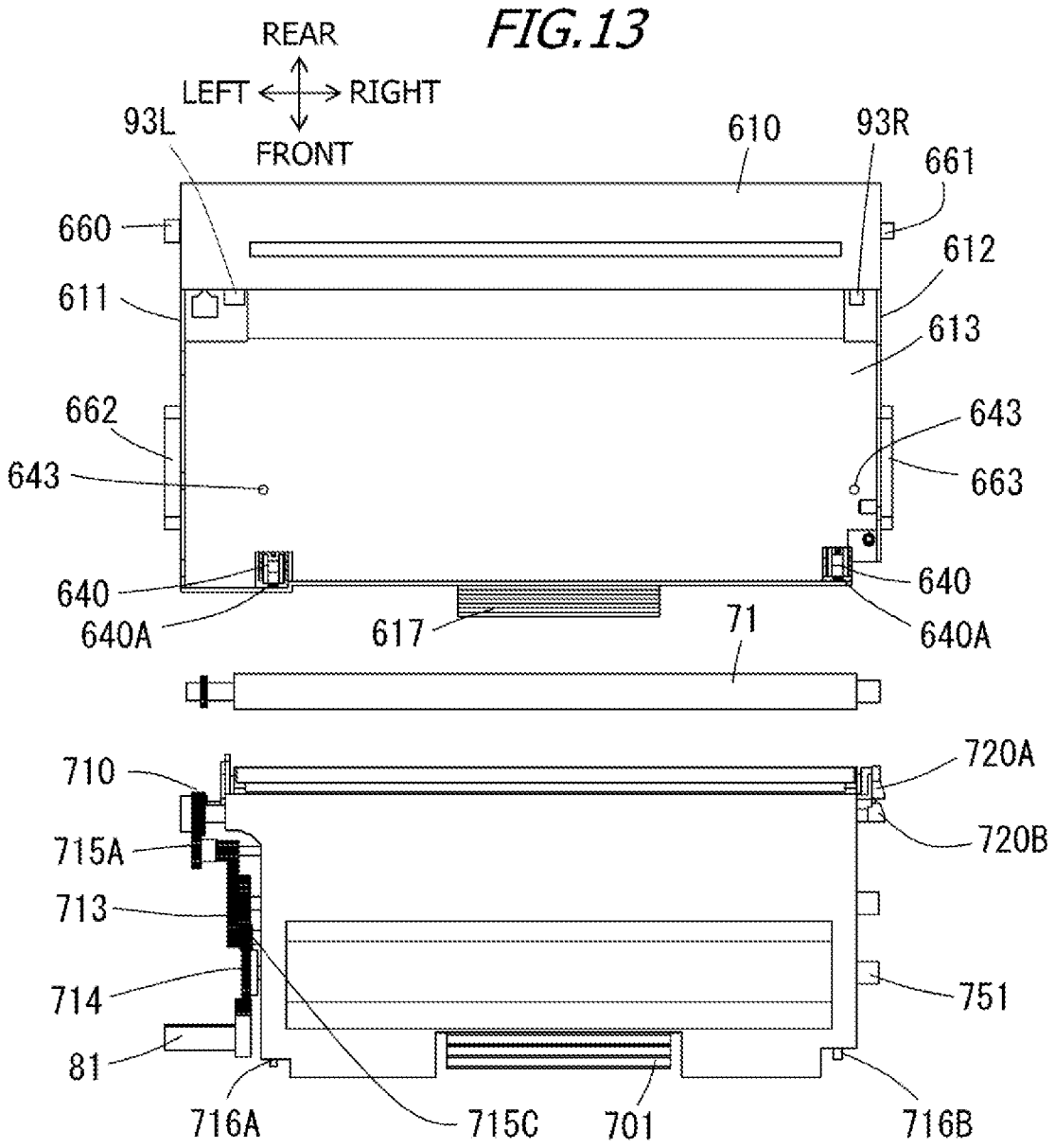
FIG. 13 is a top view of the developing unit and the photosensitive unit.
Figure 14A:
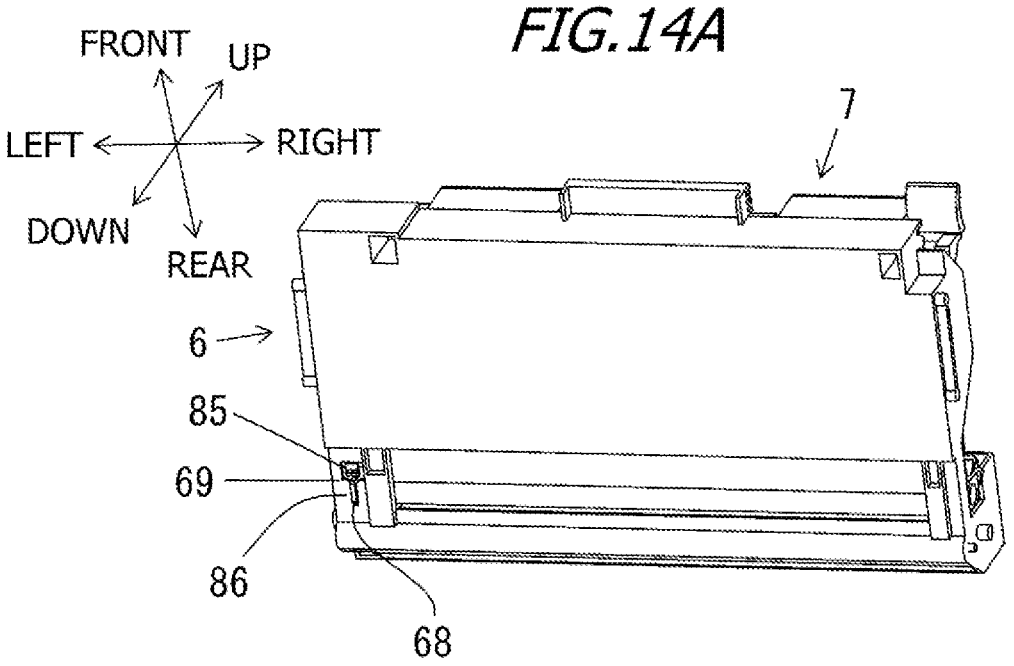
FIG. 14A and FIG. 14B are perspective views of the process cartridge.
Figure 14B:
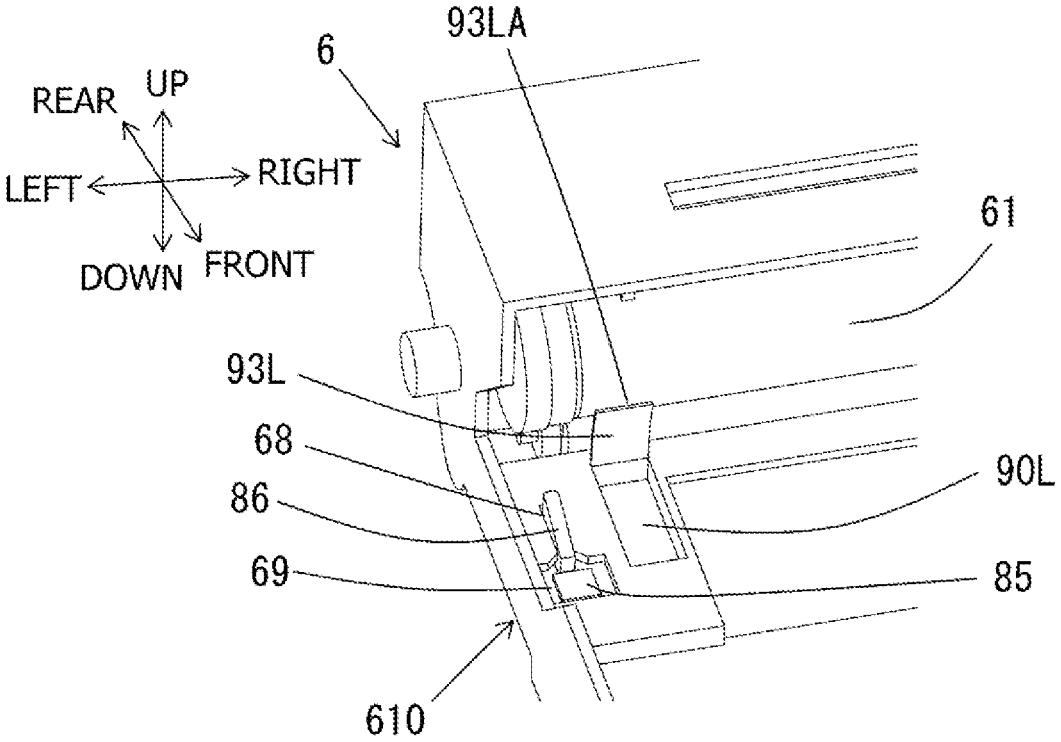

A detailed configuration of the photosensitive unit 6 will be described next. FIG. 10 is a perspective view of the process cartridge 5. FIG. 11A is a partial perspective view of the photosensitive unit 6, and FIG. 11B is a cross-sectional view sectioned at B-B in FIG. 11A. FIG. 12 is a perspective view of the developing unit 7 and the photosensitive unit 6. FIG. 13 is a top view illustrating a positional relationship of the photosensitive unit 6, the developing unit 7 and the developing roller 71 in the left-right direction. FIG. 14A is a perspective view when the process cartridge 5 is viewed from the bottom, and FIG. 14B is a perspective view of the positioning portions between the developing unit 7 and the photosensitive drum 61 of the photosensitive unit 6 in the rotation axis direction. For explanatory convenience, in FIG. 14B, an area around the positioning protrusion 86 and the memory 85 in the developing unit 7 is primarily illustrated.

As illustrated in FIG. 10, the photosensitive unit 6 includes: a frame 610 including a pair of a left side wall 611 and a right side wall 612; and the photosensitive drum 61 which is rotatably supported in the rear area of the frame 610. In the front area of the frame 610, an attaching portion 615 (see FIG. 12), where the developing unit 7 is attached, and a gripping portion 617 (see FIG. 10) for the user to hold the photosensitive unit 6 are disposed. Further, as illustrated in FIG. 12, a pressing member 640 to press down the developing unit 7 and a lift member (moving member) 642 to lift up the developing unit 7 are also disposed in the front area of the frame 610. The lift member 642 lifts up the developing unit 7 attached to the attaching portion 615. The toner storing portion 74 of the developing unit 7, attached to the attaching portion 615, is disposed between the left side wall 611 and the right side wall 612 in the left-right direction.

In the rear area of the frame 610, a first positioning protrusion 660, which protrudes from the left side wall 611 in the rotation axis direction of the photosensitive drum 61, and a first guide rib 662 are disposed (see FIG. 10 and FIG. 13). In the same manner, a second positioning protrusion 661, which protrudes from the right side wall 612 in the rotation axis direction of the photosensitive drum, 61, and a second guide rib 663 are disposed (see FIG. 10 and FIG. 13).

The lifetime of the developing unit 7, which is determined based on the amount of toner stored in the developing unit 7, is set to be shorter than the lifetime of the photosensitive unit 6, which is determined based on the thickness of the photosensitive layer of the photosensitive drum 61. Therefore it is necessary to replace only the developing unit 7 of which lifetime expired, independently from the photosensitive unit 6. In this case, the door 21 is opened and the process cartridge 5 is removed from the apparatus main body 2, the developing unit 7 of which lifetime expired is detached from the photosensitive unit 6, and another developing unit 7 is attached to the photosensitive unit 6, as indicated by the attaching direction AD in FIG. 12. Then the photosensitive unit 6, in which the new developing unit 7 is attached, is installed in the apparatus main body 2 as the process cartridge 5.

As illustrated in FIG. 7, FIG. 10 and FIG. 12, in the left side wall 611 and the right side wall 612 of the frame 610, a receiving portion 641, which receives positioning members 746A and 746B of the developing unit 7 in an area in front of the photosensitive drum 61, is formed. The receiving portion 641 is an approximately U-shaped concave portion of which front side is open when viewed from the left side. In the step of attaching the developing unit 7 to the photosensitive unit 6, the positioning members 746A and 746B are inserted into the receiving portion 641. The receiving portion 641 supports the developing unit 7 with the photosensitive unit 6, and also guides the movement of the developing unit 7 in the attaching direction AD, as illustrated in FIG. 12.

As illustrated in FIG. 13, protruding portions 643 which protrude upward are disposed near both end portions of the bottom surface (bottom portion) 613 of the frame 610 in the left-right direction. These protruding portions 643 contact ribs 718 disposed on the bottom of the housing 700 of the developing unit 7 illustrated in FIG. 9, so as to movably support the developing unit 7. In other words, the bottom surface 613 of the frame 610 includes the protruding portions (supporting portions) 643 that supports the housing 700 of the developing unit 7.

As illustrated in FIG. 12, in the photosensitive unit 6, a positioning hole 68 formed in the frame 610 and a contact opening 69 are disposed on one end side of the photosensitive drum 61 in the rotation axis direction (left-right direction). Here "one end side" refers to one side with respect to a bisector of the length of the photosensitive drum 61 in the left-right direction. When the developing unit 7 is installed in the photosensitive unit 6, the positioning protrusion 86 of the developing unit 7 is inserted into the positioning hole 68 of the photosensitive unit 6, as illustrated in FIG. 14A and FIG. 14B. The positioning protrusion 86 and the positioning hole 68 are inter-fitted in the rotation axis direction (left-right direction) of the photosensitive drum 61, whereby the position of the developing unit 7 in the left-right direction, with respect to the photosensitive unit 6, is determined. The memory 85 of the developing unit 7 is exposed to the lower part of the process cartridge 5 via the contact opening 69 of the photosensitive unit 6.

As illustrated in FIG. 11A and FIG. 14B, a box-shaped concave portion 90L is disposed in the frame 610 of the photosensitive unit 6 on a one end side of the photosensitive drum 61 in the rotation axis direction (left-right direction). The concave portion 90L is disposed at a position overlapping with the positioning hole 68 when viewed in the rotation axis direction (left-right direction) of the photosensitive drum 61. This concave portion 90L reinforces a peripheral area where strength decreased due to forming the positioning hole 68, and increases the strength of the photosensitive unit 6. As illustrated in FIG. 11B, the depth D2 of the concave portion 90L is deeper than the depth D1 of the positioning hole 68, which increases the effect of reinforcement. Because of this configuration, the strength of the peripheral area of the positioning hole 68 of the photosensitive unit 6 increases, and the positioning accuracy, between the developing unit 7 and the photosensitive unit 6 in the left-right direction using the positioning protrusion 86 of the developing unit 7 and the positioning hole 68 of the photosensitive unit 6, increases. As a result, the positioning accuracy, between the memory electrode 85A of the memory 85 and the electrode disposed in the apparatus main body 2, increases, and the electrodes can be contacted with certainty.

As illustrated in FIG. 11A and FIG. 14B, a sheet member 93L is disposed on the photosensitive drum 61 side of the concave portion 90L. A tip portion 93LA of the sheet member 93L contacts the photosensitive drum 61. Because of this configuration, unnecessary toner attached to the surface of the photosensitive drum 61 during image formation and such foreign substances as paper dust can be scraped off by the tip portion 93LA, so as to prevent imaging failure. In this configuration, the scraped unnecessary toner and such foreign substances as paper dust fall into the concave portion 90L, and are captured. This prevents contamination of the process cartridge 5 caused by the scattering of foreign substances, and prevents the generation of imaging failure caused by the falling of foreign substances on the paper S. By using the concave portion 90L to reinforce structure and capture foreign substances, it is unnecessary to dispose a configuration of capturing foreign substances separately from the concave portion 90L, and the process cartridge 5 can be downsized and a simple configuration can be realized.

As illustrated in FIG. 12, a foreign substance box 90R having a box-shaped concave portion is disposed on the opposite side of the positioning hole 68 of the photosensitive unit 6 in the left-right direction. A sheet member 93R is disposed on the photosensitive drum 61 side of the foreign substance box 90R. A tip portion 93RA of the sheet member 93R contacts the photosensitive drum 61. Similar to the above mentioned sheet member 93L, unnecessary toner attached to the surface of the photosensitive drum 61 during image formation, and such foreign substances as paper dust, can be scraped off by the tip portion 93RA, so as to prevent imaging failure. The scraped unnecessary toner and such foreign substances as paper dust fall into the foreign substance box 90R, and are captured in the box.

As illustrated in FIG. 12, the pressing member 640 is disposed in the front area of the frame 610 and is disposed on both end portions of the frame 610 in the left-right direction. Each pressing member 640 is urged in the front-to-rear direction by a compression spring 640A, i.e., urging member. Therefore by the urging force of the compression spring 640A, each pressing member 640 presses each pressed rib 716A and 716B, which is disposed in the housing 700 of the developing unit 7, respectively. By pressing the developing unit 7 by the pressing members 640, the developing roller 71 is urged to the photosensitive drum 61.

As illustrated in FIG. 12 and FIG. 7, a concave portion 664 is disposed on the left side wall 611 of the photosensitive unit 6, and the detecting portion 80 of the developing unit 7 is disposed in the concave portion 664. A part of the first guide rib 662 is disposed under the concave portion 664 so as to overlap, this is because the rigidity of the frame 610 reduces due to the concave portion 664. Since this first guide rib 662 functions as a reinforcing member, the decrease of the rigidity of the frame 610 can be suppressed.

As illustrated in FIG. 11A and FIG. 11B, a photosensitive gear (first gear) 65 and a transfer gear (second gear) 66 are fixed at the left end of the photosensitive drum 61, so as to rotate integrally with the photosensitive drum 61. When the process cartridge 5 is attached to the apparatus main body 2, a driving gear (not illustrated) of the apparatus main body 2 and the photosensitive gear 65 are engaged, whereby the driving force is transferred to the photosensitive drum 61 and the transfer gear 66, so as to be in a rotatable state. Further, the transfer gear 66 is engaged with a transfer roller gear (third gear) 67 which is fixed to the left end of the transfer roller 63, whereby the transfer roller 63 also enters the rotatable state.

Lift Mechanism of Developing Unit 7

Figure 15:
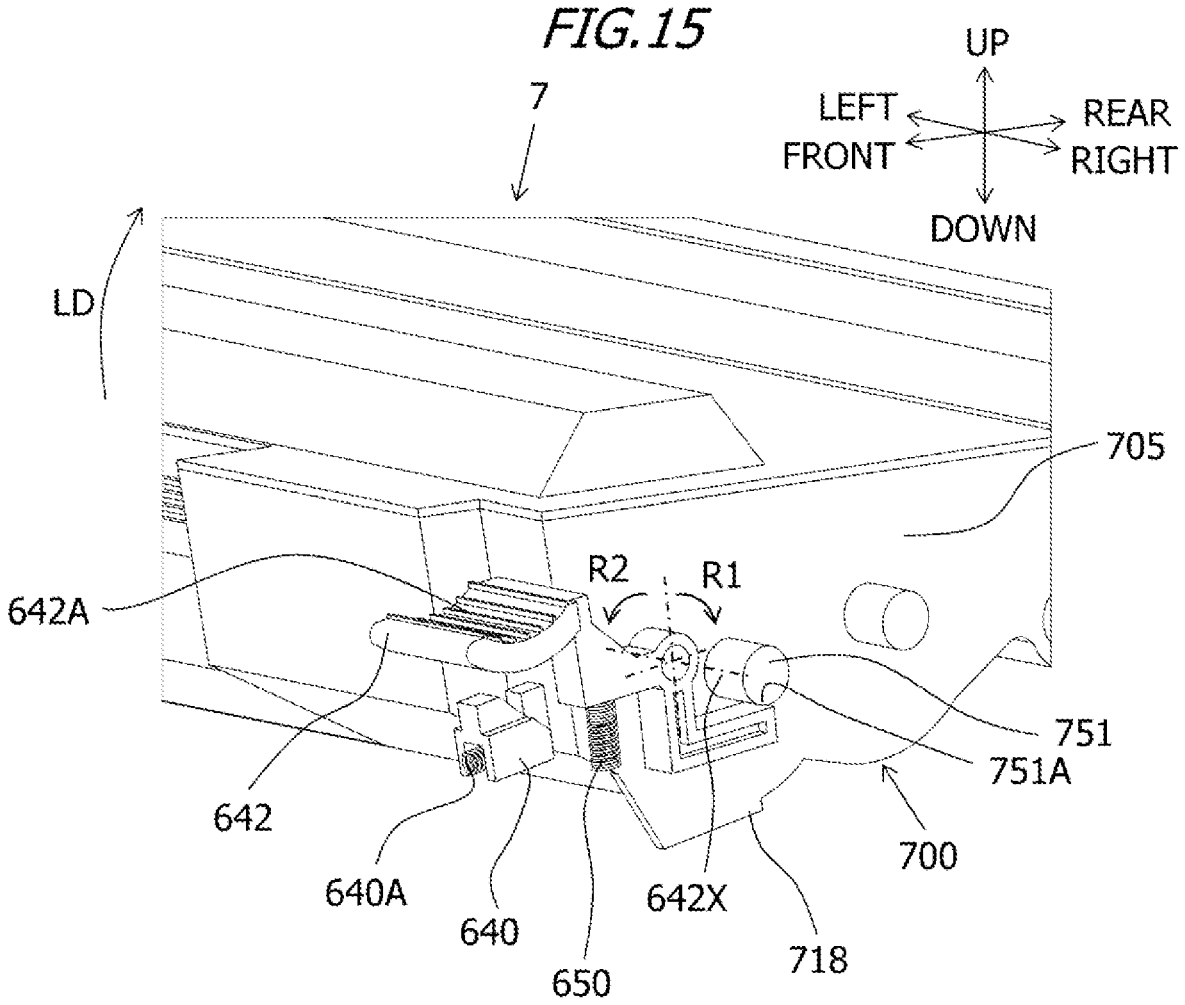
FIG. 15 is a partial perspective view of the developing unit and a lift member.
Figure 16A:
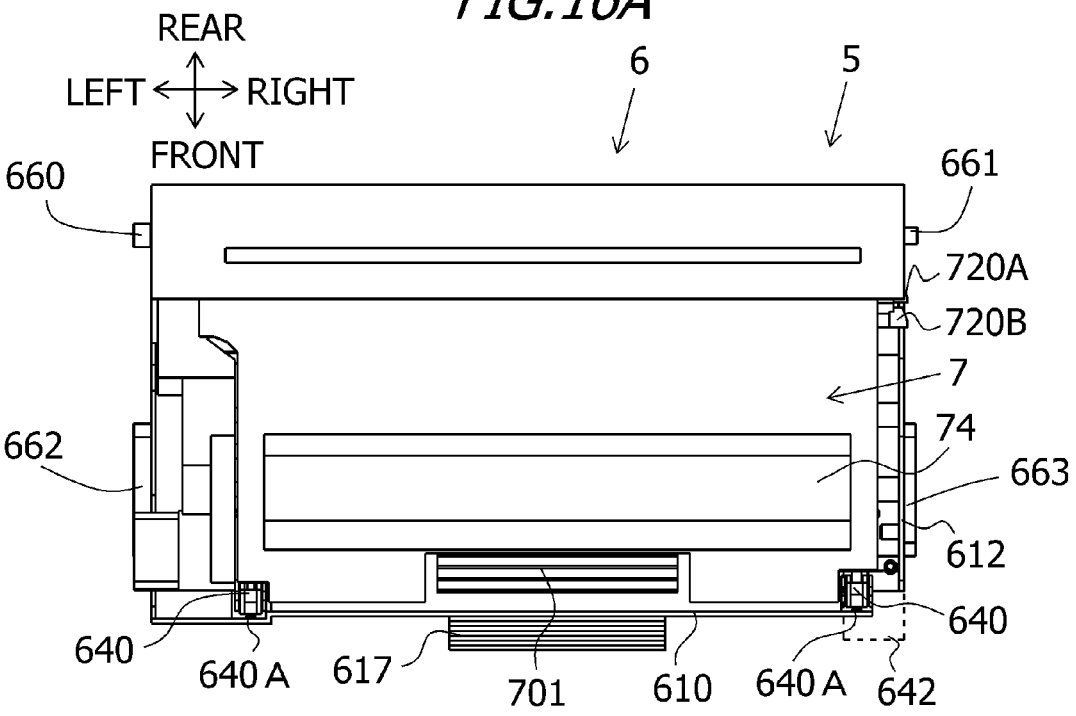
FIG. 16A and FIG. 16B are diagrams illustrating a positional relationship of the lift member and a pressing member.
Figure 16B:
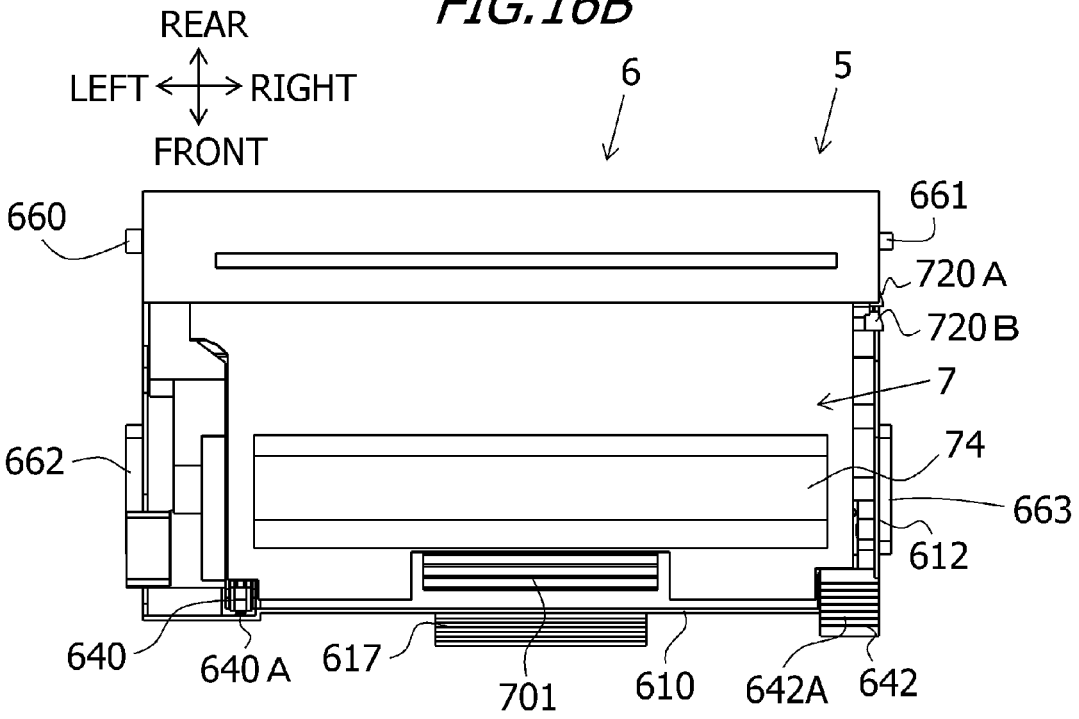
Figure 17A:
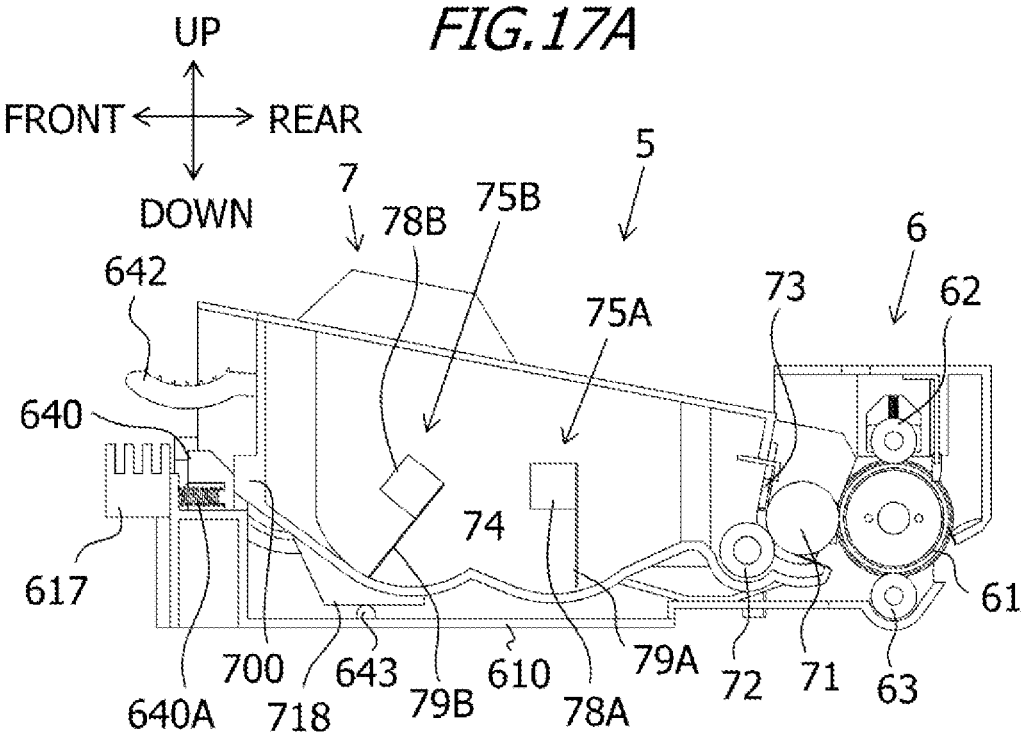
FIG. 17A and FIG. 17B are cross-sectional views of the developing unit and the photosensitive unit.
Figure 17B:
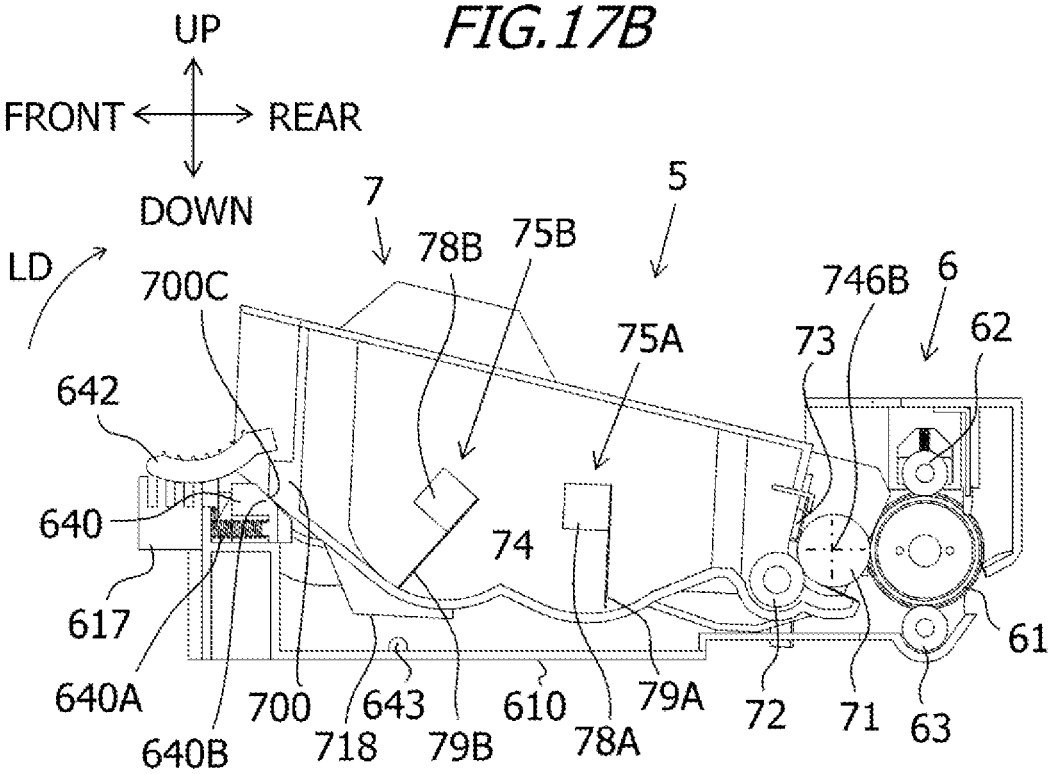

FIG. 15 is a partial perspective view of the developing unit 7 and the lift member 642. FIG. 16A and FIG. 16B are top views of the photosensitive unit 6 in which the developing unit 7 is attached. FIG. 16A is a view when the lift member 642 is omitted, and FIG. 16B is a view when the lift member 642 is included. FIG. 17A and FIG. 17B are cross-sectional views of the photosensitive unit 6 and the developing unit 7, and each cross-section is parallel with the up-down direction and the front-rear direction. FIG. 17A illustrates a state where the developing unit 7 is attached to the photosensitive unit 6, and FIG. 17B illustrates a state where the developing unit 7 is placed on the photosensitive unit 6. The developing unit 7 attached to the photosensitive unit 6 is changed to the lift up state by the lift mechanism, and is then detached from the photosensitive unit 6. This lift mechanism will be described next in detail.

As illustrated in FIG. 15, FIG. 16A and FIG. 16B, at least a part of the lift member 642 is disposed on the front side of the housing 700 of the developing unit 7, and is rotatably supported by the right side wall 612 in the state of receiving the force of the compression spring 650. Further, at least a part of the lift member 642 is disposed so as to overlap with the right side wall 705 of the housing 700 to store toner and the pressing member 640 in the front-rear direction. A rotation axis line 642X of the lift member 642 is parallel with the left-right direction (rotation axis direction of the photosensitive drum 61). The lift member 642 is urged in the rotation direction R1 by the force of the compression spring 650.

When the user pushes an operating portion 642A of the lift member 642 against the force of the compression spring 650 to rotate the lift member 642 in the R2 direction, the lift member 642 presses a protruding portion 751 and moves the developing unit 7 in a releasing direction LD to release the developing unit 7 from the photosensitive unit 6. Thereby the developing unit 7 can be detached from the photosensitive unit 6. The operating portion 642A is disposed on the right end side (one end side) of the photosensitive unit 6.

As illustrated in FIG. 17A, in the state where the developing unit 7 is attached to the photosensitive unit 6, the housing 700 is pressed by the pressing member 640, whereby the developing roller 71 is pressed to the photosensitive drum 61. Furthermore, the developing unit 7 is locked by the pressing member 640 so as not to be released from the photosensitive unit 6.

As illustrated in FIG. 15, one end of the lift member 642 moves a contact surface (contact portion) 751A of the protruding portion 751 of the housing 700 upward. Thereby the developing unit 7 can be moved from the attaching position being attached to the attaching portion 615 (see FIG. 12) in the releasing direction LD, and be released from the photosensitive unit 6.

As illustrated in FIG. 17B, as the front area of the developing unit 7 is released from the photosensitive unit 6, in the developing unit 7, a supported surface 700C of the housing 700 is held at a temporary support position supported by a holding portion 640B of the pressing member 640. Further, in the developing unit 7 that is held at a temporary support position, the positioning member 746A (see FIG. 12) and the positioning member 746B (see FIG. 17B) are being supported by the receiving portion 641. This state is referred to as a "lift up state". At this time, lock (regulation whether the developing unit 7 is detached from the photosensitive unit 6) is in a released state. In this lift up state, the user can detach the developing unit 7 from the photosensitive unit 6 by holding a gripping portion 701, and simply lifting the developing unit 7 without moving other members. In this way, the user can detach the developing unit 7 from the photosensitive unit 6 and attach a new developing unit 7 to the photosensitive unit 6. When the developing unit 7 is attached to the photosensitive unit 6, the developing roller 71 contacts the photosensitive drum 61.

Figure 18:
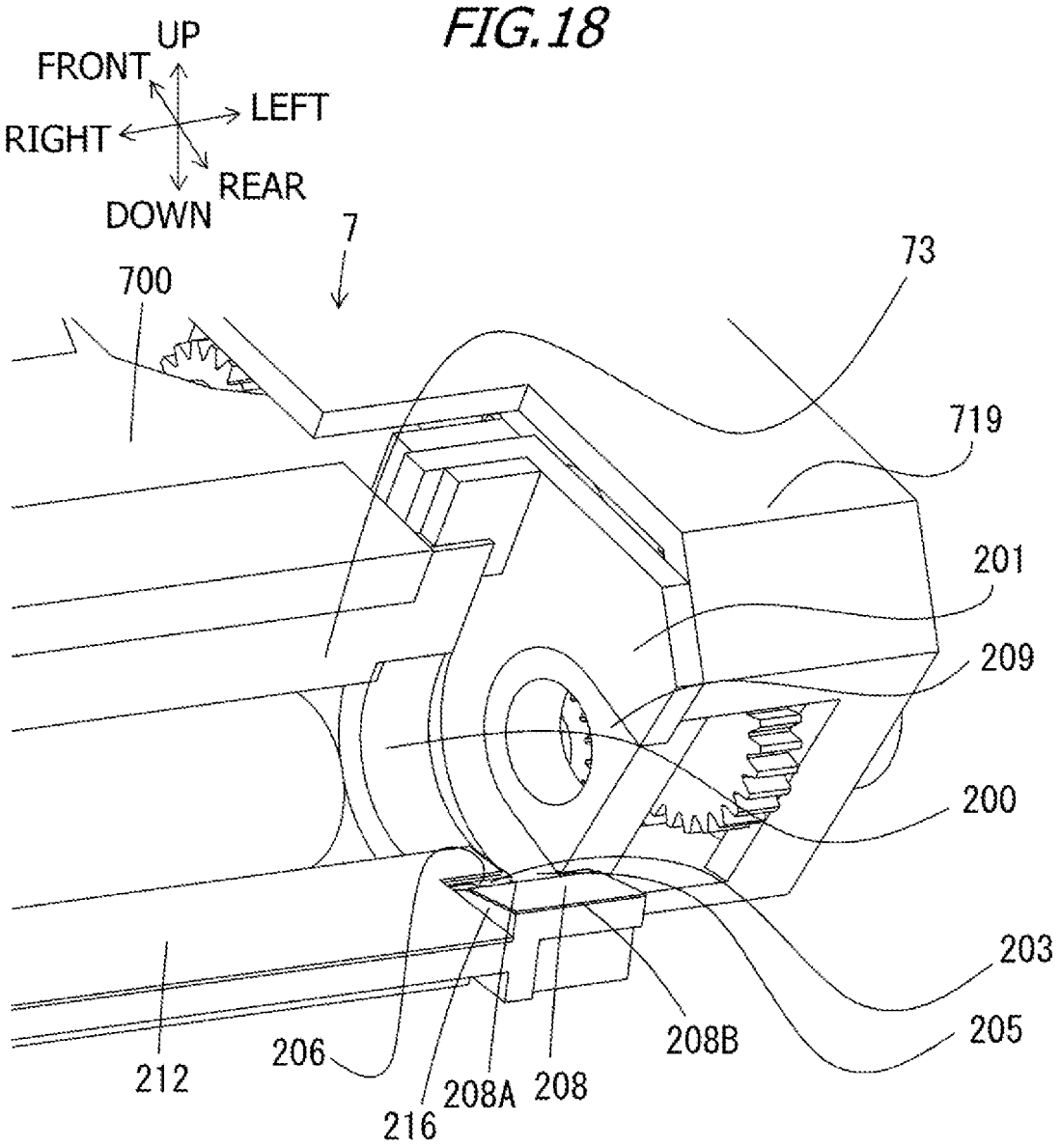
FIG. 18 is a partial perspective view of the developing unit.
Figure 19:
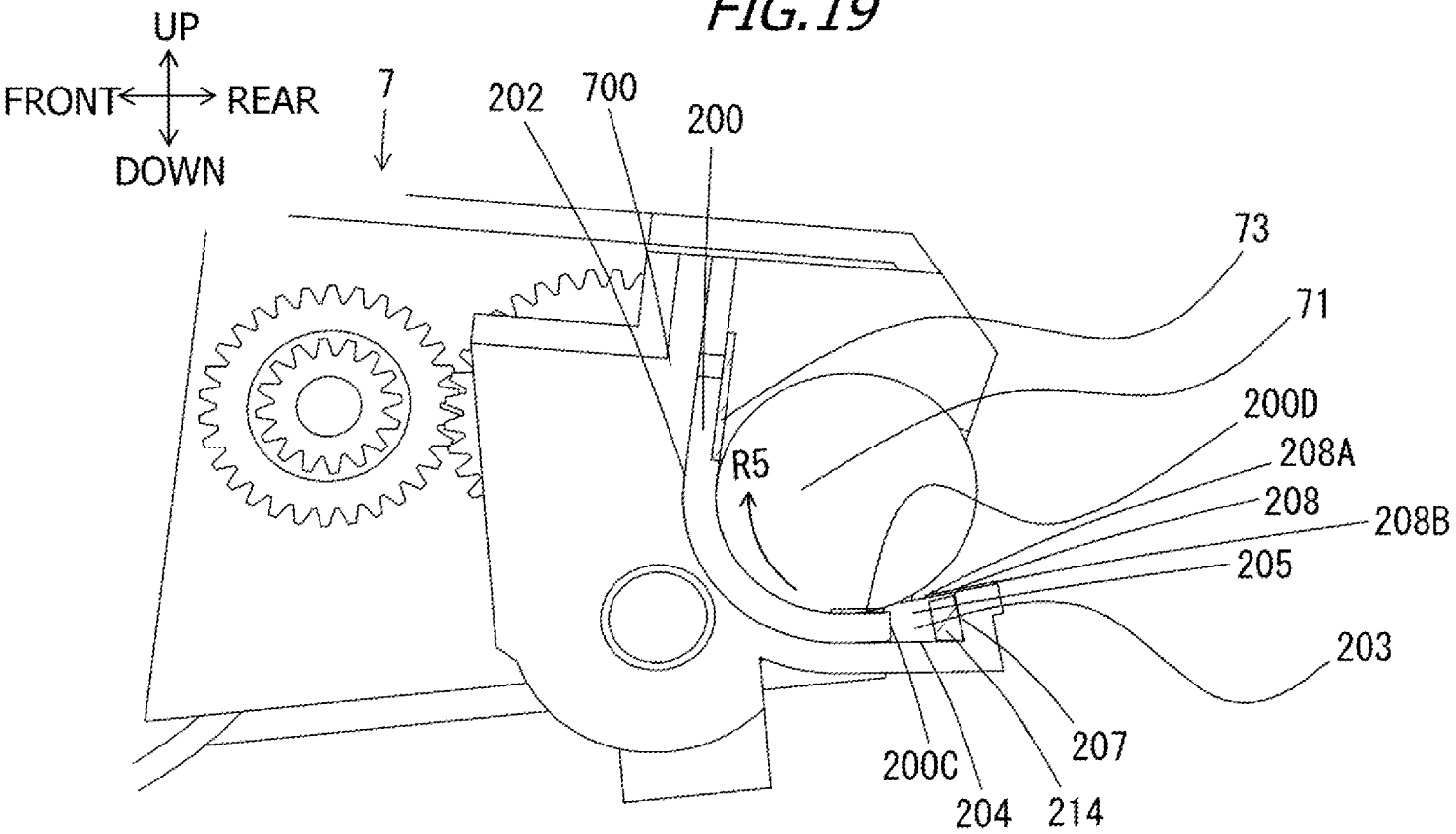
FIG. 19 is a partial cross-sectional view of the developing unit.

FIG. 18 is a partial perspective view of the developing unit 7 when the developing roller 71 is omitted, and FIG. 19 is a partial cross-sectional view of the developing unit 7 in the posture of being attached in the process cartridge 5. The developing unit 7 is constituted of the housing 700 including an attaching surface 202, which is arc-shaped when viewed in the left-right direction; and a side seal 200 which contacts each end portion of the developing roller 71 in the longer direction, and prevents the toner from leaking to outside through a gap between the developing roller 71 and the housing 700. Furthermore, the developing unit 7 includes a toner sealing member 212, i.e., sealing sheet which contacts the center portion of the developing roller 71 in the rotation axis direction of the developing roller 71, and prevents the toner from leaking to outside through a gap between the developing roller 71 and the housing 700. In Embodiment 1, the configuration of one side of the end portions of the developing unit 7 is described as an example, but the same configuration is disposed in the opposite side of the end portions of the developing unit 7.

The attaching surface 202 of the housing 700 is a mounting surface of which the side seal 200 is mounted. The side seal 200 is a member, on which a surface member, having shaggy fibers, is attached to the surface of an elastic base material, and this side seal 200 is attached to the attaching surface 202 of the housing 700. The side seal 200 is configured to return the toner attached to each end portion of the developing roller 71 back to the toner storing portion 74, or to capture the toner inside the side seal 200. The toner which is not captured is carried by the developing roller 71 again and returned to the side seal 200 by the rotation of the developing roller 71. The housing 700 includes a concave-shaped toner receiving portion 203, of which upper area is open, on the upstream side of the side seal 200 in the rotating direction R5 of the developing roller 71. The toner receiving portion 203 is a space where the toner can be stored. The toner receiving portion 203 is disposed on an upstream side of the side seal 200 and on a downstream side of a contact portion where the developing roller 71 contacts the photosensitive drum 61 when viewed in the rotating direction R5 of the developing roller 71, and includes an opening that faces the developing roller 71. The toner receiving portion 203 is disposed at a position overlapping with the side seal 200 when viewed in the rotation axis direction of the developing roller 71.

Figure 20:
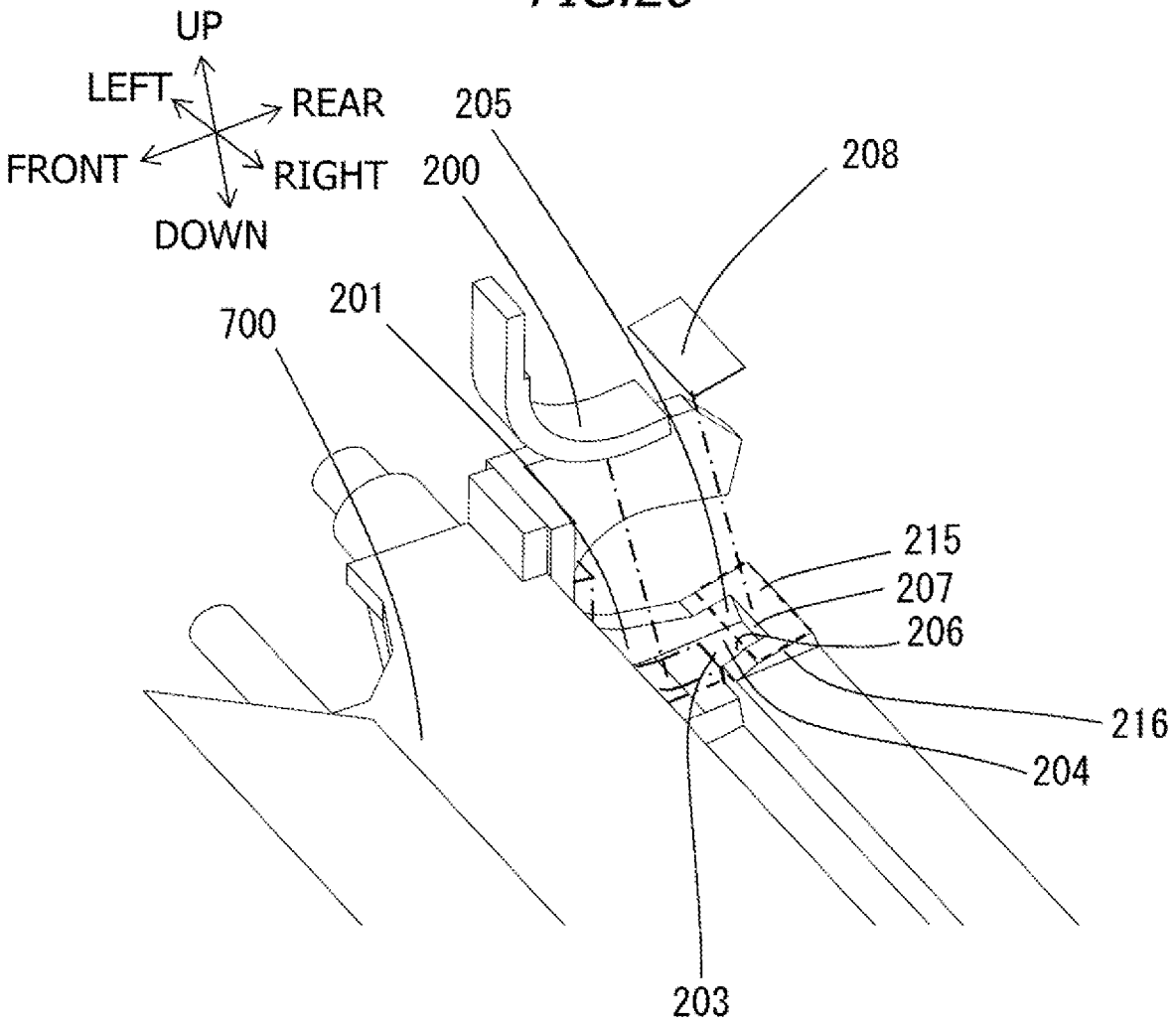
FIG. 20 is an exploded perspective view of the developing unit.

FIG. 20 is an exploded perspective view of the developing unit 7. As illustrated in FIG. 18 to FIG. 20, the concave portion of the toner receiving portion 203 is constituted of five surfaces: a bottom wall surface 204, a first wall surface 205, a second wall surface 206, a third wall surface 207, and an upstream side end surface 200C of the side seal 200. In other words, the first wall surface 205, the second wall surface 206, the third wall surface 207, and the upstream side end surface 200C of the side seal 200 surrounds the bottom wall surface 204. In a state where the toner is stored in the toner receiving portion 203, the toner can contact the bottom wall surface 204, the first wall surface 205, the second wall surface 206, the third wall surface 207, and the upstream side end surface 200C of the side seal 200. The bottom wall surface 204 is formed on the same plane as the attaching surface 202. A part of the bottom wall surface 204 may be a part of the attaching surface 202. The bottom surface and a part of the side surface of the toner receiving portion 203 are formed by the housing 700, and a part of the toner receiving portion 203 is formed by the side seal 200. The side seal 200 may be disposed so as to extend over the attaching surface 202 and the bottom wall surface 204.

The first wall surface 205 is formed on the same plane as the right side surface of a bearing holding portion 201 which holds a bearing member 209 to rotatably support the developing roller 71. The second wall surface 206 is formed on the right side of the side seal 200 so as to face the first wall surface 205. The third wall surface 207 is formed on the rear side of the end surface 200C so as to face the end surface 200C. The end surface 200C and the third wall surface 207 are disposed away from each other by a predetermined distance. The developing unit 7 also includes a sheet-type blocking member 208 which blocks at least a part of the upper opening of the concave portion. The blocking member 208 is disposed between the opening of the toner receiving portion 203 and the developing roller 71. Specifically, when the developing roller 71 is viewed in the rotation axis direction, the blocking member 208 is disposed between the opening of the toner receiving portion 203 and the developing roller 71 in the direction perpendicular to the rotation axis direction of the developing roller 71. The blocking member 208 does not contact the developing roller 71, and is disposed at a position away from the developing roller 71. Further, the blocking member 208 does not contact the side seal 200 and is disposed at a position away from the side seal 200. In other words, a gap is formed between the blocking member 208 and the developing roller 71, and a gap is formed between the blocking member 208 and the side seal 200. The blocking member 208 is fixed to a blocking member attaching surface 215 (see FIG. 20), which has a surface crossing with the third wall surface 207, using double-sided tape, adhesive, or the like. The blocking member attaching surface 215 is connected with the third wall surface 207. One end of the toner sealing member 212 contacts an abutting surface 216, which is disposed in the rotation axis direction of the developing roller 71 on the right side of the second wall surface 206. Further, the toner sealing member 212 is disposed such that a part of the toner sealing member 212 on the tip side (front side) rises over the side seal 200. The blocking member 208 is a separate component from the toner sealing member 212. The blocking member 208 is disposed at a place away from the toner sealing member 212, and a gap is formed between the blocking member 208 and the toner sealing member 212.

A part of the toner which is not captured by the side seal 200 is scraped by a developing roller contact portion 200D disposed on the upstream side of the side seal 200 in the rotating direction of the developing roller 71, and is collected in the toner receiving portion 203. This prevents the toner from leaking out of the developing unit 7. As a result, the scattering of the toner out of the process cartridge 5 can be suppressed.

Figure 21:
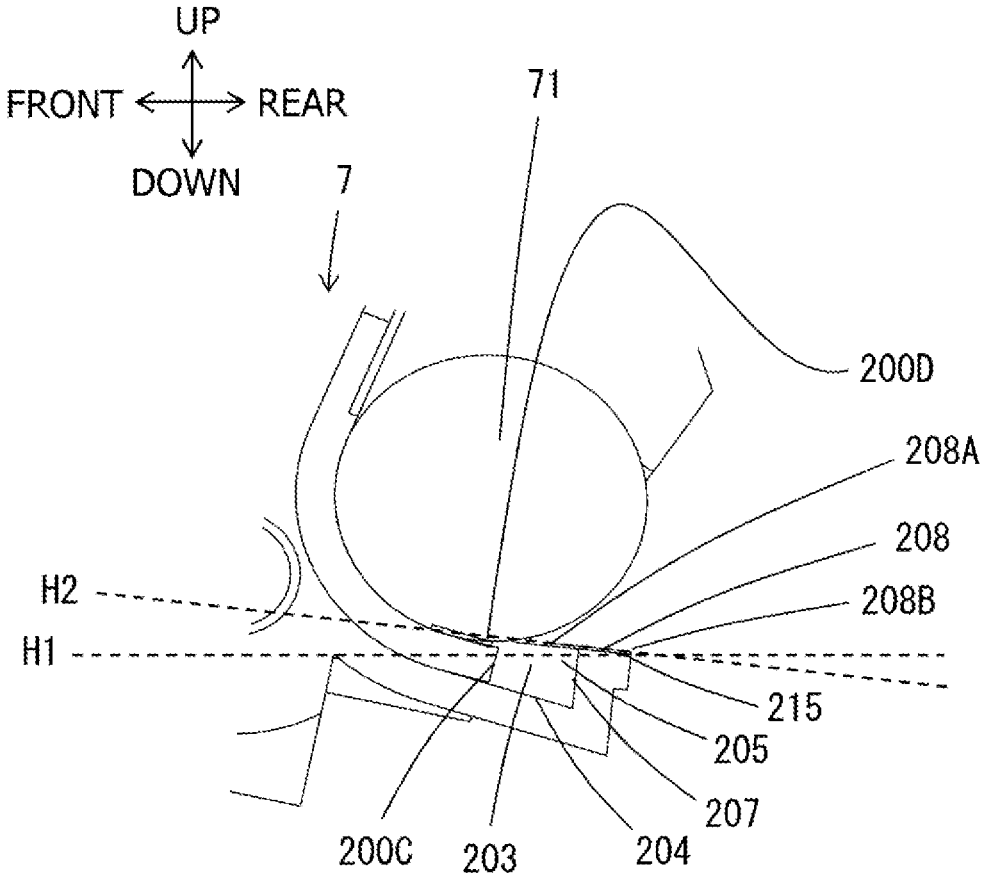
FIG. 21 is a cross-sectional view of the developing unit in a lift up state.

It is also necessary to prevent the toner collected in the toner receiving portion 203 from leaking out of the developing unit 7 during the attachment and detachment operation of the developing unit 7 to and from the photosensitive unit 6. For this, the position of the blocking member 208 is set such that the line connecting a tip portion 208A and a base portion 208B (line H2) of the blocking member 208 in the above mentioned lift up state (see FIG. 17B) is above the horizontal line (line H1) in the front direction, as illustrated in FIG. 21. The tip portion 208A is located on the side closer to the developing roller 71 than the base portion 208B, and the base portion 208B is fixed to the blocking member attaching surface 215. In other words, in the lift up state, the tip portion 207A is located above the base portion 208B in the vertical direction. Moreover, in the lift up state, the blocking member 208 is disposed such that the surface facing the toner receiving portion 203 is located lower than the surface facing the developing roller 71. Because of this configuration, the leakage of the toner out of the developing unit 7 can be prevented, even during the attachment and detachment operation of the developing unit 7 to and from the photosensitive unit 6. As a result, the scattering of the toner out of the process cartridge 5 can be suppressed, even during the attachment and detachment operation of the developing unit 7 to and from the photosensitive unit 6.

The capturing amount of the toner can be increased by disposing a toner capturing member 214 having shaggy fibers inside the toner receiving portion 203, as illustrated in FIG. 19, so as to capture the toner into the toner capturing member 214. In Embodiment 1, the toner capturing member 214 is attached to the bottom wall surface 204 on the upstream side in the rotating direction R5 of the developing roller 71, so as to be separated from the end surface 200C by a predetermined distance. This means that a space is created between the end surface 200C and the toner capturing member 214. Thereby the toner collected in the toner receiving portion 203 is captured by the toner capturing member 214, and the leakage of the toner out of the developing unit 7 can be prevented. The length of the fibers, and the like, of the toner capturing member 214 can be freely set as long as toner can be captured, or a toner capturing member 214 having an adsorption material may be disposed.

According to the description of Embodiment 1, the bottom wall surface 204, the first wall surface 205, the second wall surface 206, and the third wall surface 207 are a part of the housing 700, and the blocking member 208 is a sheet member that is a separate component from the housing 700, but the toner receiving portion 203 is not limited to this configuration. The toner receiving portion 203 may have a different configuration. For example, the first wall surface 205, the second wall surface 206 and the third wall surface 207 may be formed by a sheet member. Further, the blocking member 208 may be disposed as a part of the housing 700, or the blocking member 208 may be a component integrated with the toner sealing member 212, and the dividing method of the components and the materials of the components are selectable as required.

Embodiment 2

Embodiment 2 of the present invention will be described next with reference to FIG. 22. In Embodiment 2, differences from the above described Embodiment 1 will be described in detail. Unless otherwise specified, configuration is the same as described in Embodiment 1, hence a composing element that is the same as Embodiment 1 is denoted with the same reference sign as Embodiment 1, for which detailed description is omitted.

Figure 22:
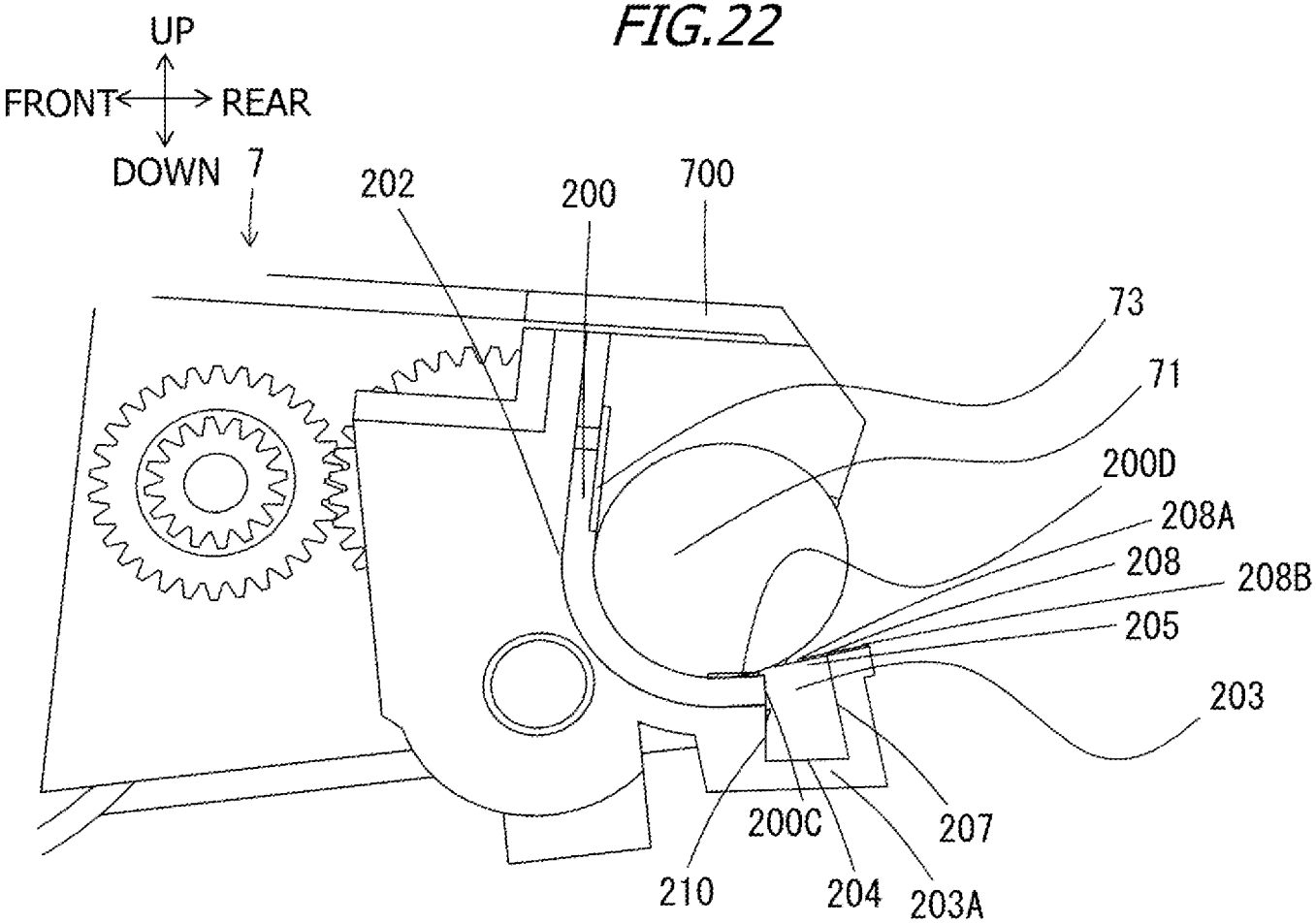
FIG. 22 is a cross-sectional view of the developing unit.

FIG. 22 is an illustration of the configuration of the toner receiving portion 203 of Embodiment 2. In Embodiment 1, the bottom wall surface 204 is formed on the same plane as the attaching surface 202, but the concave portion may be deeper than the attaching surface 202 downward in the gravitational direction. In other words, the toner receiving portion 203 may have a concave portion that is deeper than the attaching surface 202 downward in the gravitational direction. The bottom wall surface 204 is surrounded by the first wall surface 205, the second wall surface 206, the third wall surface 207 and the fourth wall surface 210. The fourth wall surface 210 is formed so as to face the third wall surface 207. In the posture when the process cartridge 5 is in use, the bottom portion 203A of the toner receiving portion 203 is located lower than the attaching surface 202 in the gravitational direction. Thereby the capacity of the toner receiving portion 203 increases, and the leakage of the toner out of the developing unit 7 can be prevented even if the toner capturing amount increases as the developing unit 7 is used for a long time. In the state where the toner is stored in the toner receiving portion 203, toner contacts the bottom portion 203A.

The end surface 200C and the fourth wall surface 210 may be disposed on the same plane. The length between the third wall surface 207 and the end surface 200C (first length) may be the same as the length between the third wall surface 207 and the fourth wall surface 210 (second length). The length between the third wall surface 207 and the end surface 200C (first length) may be shorter or longer than the length between the third wall surface 207 and the fourth wall surface 210 (second length). The groove of the concave portion of the toner receiving portion 203 may have a cylindrical shape, rectangular parallelepiped shape or a shape of which cross-section increases and/or decreases downward in the gravitational direction, and the method of increasing the capacity of the toner receiving portion 203 can be freely chosen. The capacity of the toner receiving portion 203 may be secured to be sufficiently large with respect to the amount of toner that can be actually captured. Then the leakage of the toner out of the developing unit 7 can be prevented, even if the toner moves by the operation of attachment and detachment of the developing unit 7 to and from the photosensitive unit 6, without disposing the blocking member 208 inside the toner receiving portion 203. As a result, scattering of the toner out of the process cartridge 5 can be suppressed.

In Embodiment 2, the capacity of the toner receiving portion 203 is ensured by sufficiently deepening the bottom wall surface 204 downward in the gravitational direction.

Whereby the leakage of the toner out of the developing unit 7 can be prevented without disposing the blocking member 208. Needless to say, the leakage of the toner may be further suppressed by disposing the blocking member 208, similarly to Embodiment 1. Furthermore, the toner capturing member 214 described in Embodiment 1 may be disposed inside the toner receiving portion 203. Thereby the toner can be captured inside the toner capturing member 214, and the toner capturing amount increases.

Embodiment 3

Embodiment 3 of the present invention will be described next with reference to FIG. 23. In Embodiment 3, differences from the above described Embodiment 1 will be described in detail. Unless otherwise specified, configuration is the same as described in Embodiment 1, hence a composing element that is the same as Embodiment 1 is denoted with the same reference sign, for which detailed description is omitted.

Figure 23:
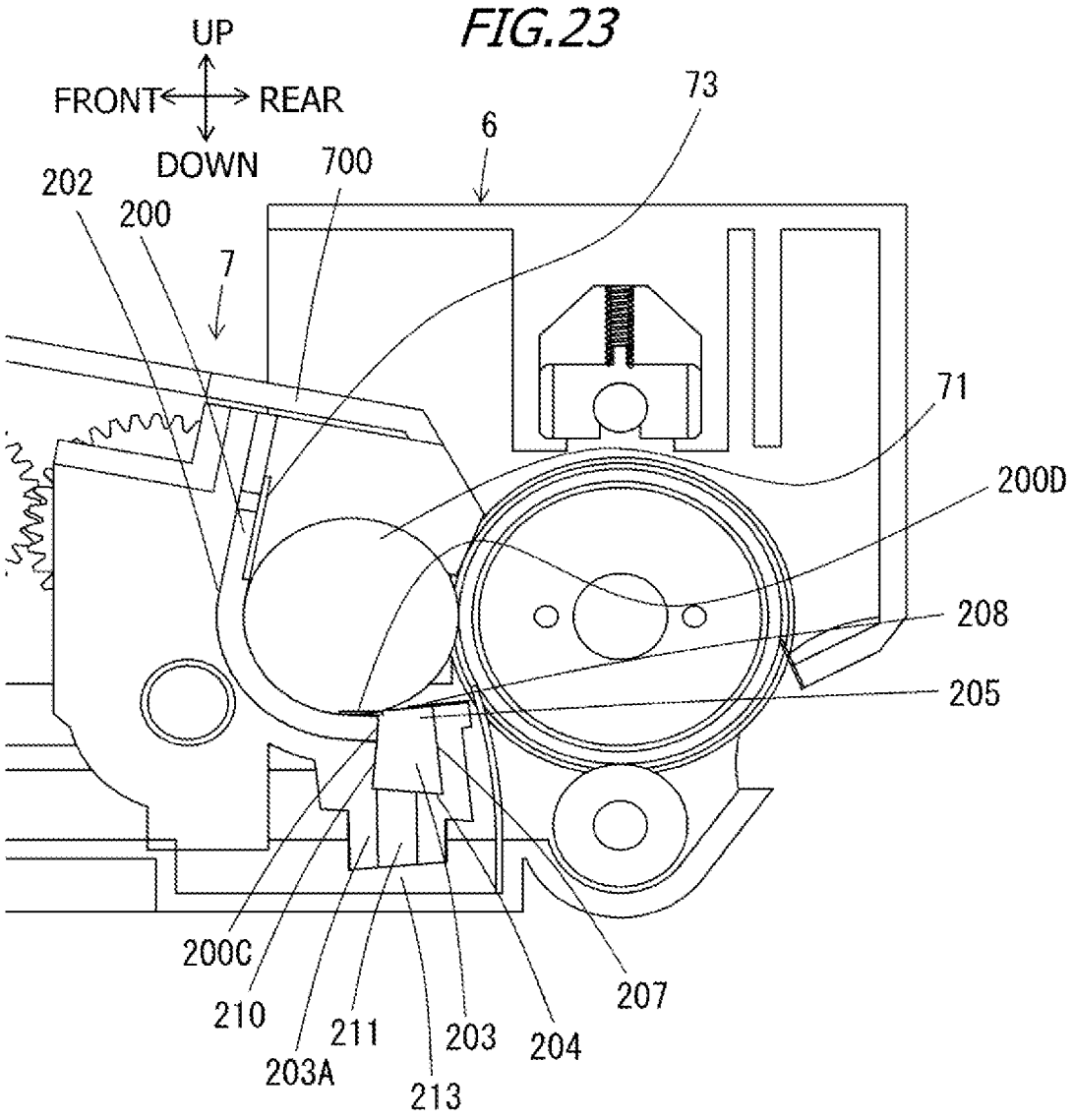
FIG. 23 is a cross-sectional view of the process cartridge.

FIG. 23 is an illustration of the configuration of the toner receiving portion (toner storing portion) 213 of Embodiment 3. In Embodiment 3, the toner receiving portion 213 is disposed in the photosensitive unit 6. In Embodiment 3, the concave portion 90L and the foreign substance box 90R (see FIG. 12) described in Embodiment 1 are used for the toner receiving portion 213.

In the developing unit 7, in a posture when the process cartridge 5 is in use, a through-hole 211, which penetrates the bottom wall surface 204 downward in the gravitational direction is provided. In other words, the housing 700 of the developing unit 7 has a through-hole 211 in the bottom portion 203A of the toner receiving portion 203. Further, in the state where the developing unit 7 is attached to the photosensitive unit 6, the toner receiving portion 213 is disposed in the photosensitive unit 6 under the through-hole 211 in the gravitational direction. Thereby the toner scraped by the developing roller contact portion 200D, disposed on the upstream side of the side seal 200, is discharged to the toner receiving portion 213 via the through-hole 211 formed in the bottom wall surface 204. The toner receiving portion 213 stores the toner discharged through the through-hole 211. According to Embodiment 3, the leakage of the toner out of the developing unit 7 can be prevented, and the scattering of the toner out of the process cartridge 5 can be suppressed.

In Embodiment 3, the concave portion 90L and the foreign substance box 90R (see FIG. 12) of Embodiment 1 are used for the toner receiving portion 213, but a toner receiving portion 213 that is independent from the concave portion 90L and the foreign substance box 90R may be disposed in either the photosensitive unit 6 or the developing unit 7. The bottom wall surface 204 may be formed on the same plane as the attaching surface 202 similarly to Embodiment 1, and the through-hole 211 may be formed in the bottom portion 203A of the toner receiving portion 203. Further, a concave portion may be formed below the attaching surface 202 in the gravitational direction, and the through-hole 211 may be formed in the bottom portion 203A of the toner receiving portion 203 similarly to Embodiment 2. In the case of the configuration illustrated in FIG. 23, the concave portion is formed below the attaching surface 202 in the gravitational direction. The through-hole 211 may have a cylindrical shape, a rectangular parallelepiped shape or a shape of which cross-section increases and/or decreases downward in the gravitational direction, and the method of increasing the capacity of the through-hole 211 can be freely chosen. Thereby arrangement of the toner receiving portion 213 becomes more flexible, and a larger capacity can be ensured. Furthermore, the toner capturing member 214 described in Embodiment 1 may be disposed inside the toner receiving portion 203. Thereby the toner can be captured inside the toner capturing member 214, and the toner capturing amount increases.

According to the present invention, a process cartridge that can suppress the scattering of toner out of the process cartridge can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-235902, filed on Dec. 26, 2019, which is hereby incorporated by reference herein in its entirety.

What is claimed is:

1. A process cartridge comprising:

a photosensitive unit including a photosensitive member and a bottom portion; and a developing unit configured to be attachable to and detachable from the photosensitive unit, the developing unit including a frame configured to store toner, a developing roller configured to carry the toner and be rotatable to convey the toner to the photosensitive member, the developing roller contacting the photosensitive member at a contact portion;

a seal configured to contact an end portion of the developing roller in a rotation axis direction of the developing roller and prevent the toner from leaking to outside through a gap between the developing roller and the frame, the seal including a first portion contacting the developing roller and a second portion disposed in an upstream side of the first portion in a rotating direction of the developing roller, and a first sheet configured to contact a center portion of the developing roller in the rotation axis direction and prevent the toner from leaking to outside through a gap between the developing roller and the frame, a wall facing the second portion and disposed away from the second portion such that a toner receiving portion is formed between the wall and the second portion, wherein the toner receiving portion includes an opening facing the developing roller and is disposed on an upstream side of the seal and a downstream side of the contact portion in the rotating direction of the developing roller, and the toner receiving portion is disposed at a position overlapping with the seal in the rotation axis direction of the developing roller, and the developing unit includes a blocking member configured to cover at least a part of the opening, the blocking member is disposed between the opening and the developing roller and is disposed between the bottom portion and the developing roller.

2. The process cartridge according to claim 1, wherein the frame has a mounting surface on which the seal is mounted, and a bottom portion of the toner receiving portion is located lower than the mounting surface in a gravitational direction in a posture when the process cartridge is in use.

3. The process cartridge according to claim 1, wherein the frame has a through-hole at a bottom portion of the toner receiving portion, and the photosensitive unit includes a toner storing portion configured to store toner discharged from the through-hole.

4. The process cartridge according to claim 1, wherein the frame has a through-hole at a bottom portion of the toner receiving portion, and the developing unit includes a toner storing portion configured to store toner discharged from the through-hole.

5. The process cartridge according to claim 1, wherein a capturing member configured to capture the toner is disposed inside the toner receiving portion.

6. The process cartridge according to claim 1, wherein the blocking member is disposed at a position away from the developing roller.

7. The process cartridge according to claim 1, wherein the blocking member is disposed at a position away from the seal.

8. The process cartridge according to claim 1, wherein the toner receiving portion has a concave portion that is recessed downward from the mounting surface in a gravitational direction.

9. The process cartridge according to claim 1, wherein the blocking member is a second sheet extending from the wall toward the second portion.

10. The process cartridge according to claim 1, wherein the photosensitive unit includes a first side wall that includes a first receiving portion configured to receive the developing unit, a second side wall that includes a second receiving portion configured to receive the developing unit.

11. The process cartridge according to claim 1, the bottom surface includes a supporting portion configured to support the frame.

12. The process cartridge according to claim 1, wherein the bottom portion is located lower than the toner receiving portion in a gravitational direction in a posture when the process cartridge is in use.

* * * * *